US005545019A

United States Patent [19]

Beck et al.

[11] Patent Number: 5,545,019

[45] Date of Patent: Aug. 13, 1996

[54] SCROLL COMPRESSOR DRIVE HAVING A BRAKE

[75] Inventors: Norman G. Beck; Gary J. Anderson, both of Sidney; Richard S. Tucker, Quincy, all of Ohio

[73] Assignee: Copeland Corporation, Sidney, Ohio

[21] Appl. No.: 401,174

[22] Filed: Mar. 9, 1995

Related U.S. Application Data

[63] Continuation-in-part of Ser. No. 970,485, Nov. 2, 1992, abandoned.

[51] Int. Cl.[6] ..... F01C 1/04

[52] U.S. Cl. ..... 418/55.1; 188/82.1

[58] Field of Search ..... 418/55.1; 74/595; 188/30, 61, 82.1

[56] References Cited

U.S. PATENT DOCUMENTS 4,415,318 11/1983 Butterworth et al. ..... 418/55

4,522,574 6/1985 Arai et al. .

4,867,282 9/1989 Hartley ..... 188/82.1

5,108,274 4/1992 Kakuda et al. ..... 418/55.1

*Primary Examiner*—Charles Freay

*Attorney, Agent, or Firm*—Harness, Dickey & Pierce

[57] ABSTRACT

Disclosed are several embodiments of a stopping device operable between the drive shaft and/or orbiting scroll of a scroll compressor and a fixed wall forming part of the compressor, for the purposes of automatically engaging the wall upon reverse operation of the compressor to thereby quickly stop such reverse operation. Damage to the compressor in the event of powered reverse is also prevented, either by permitting the machine to run free or by quickly stopping it. Also disclosed are several ways to facilitate start-up with weak motors.

102 Claims, 28 Drawing Sheets

Fig. 29.
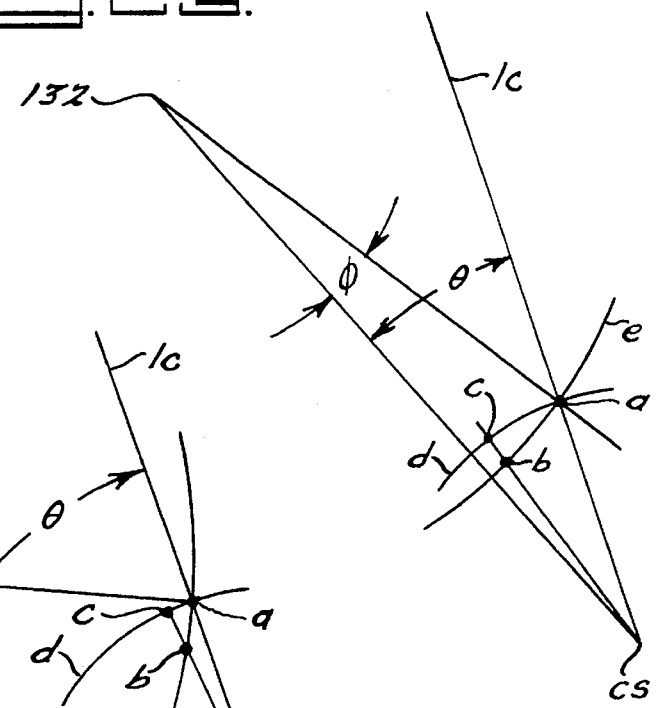
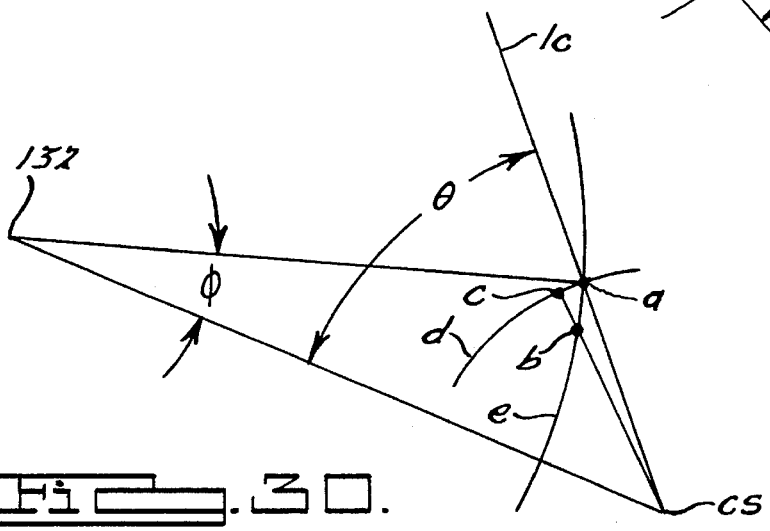
Fig. 30.
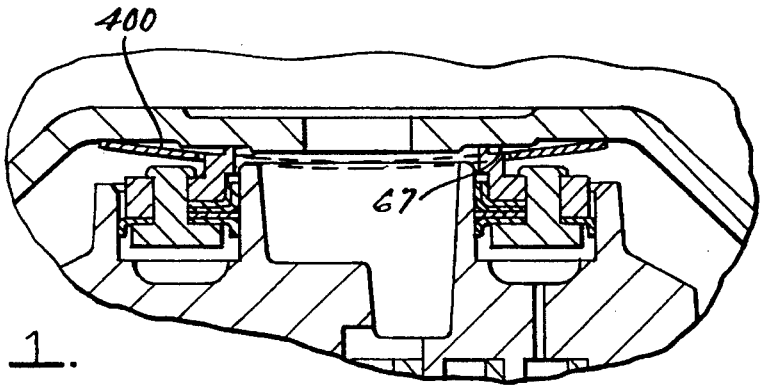
Fig. 31.
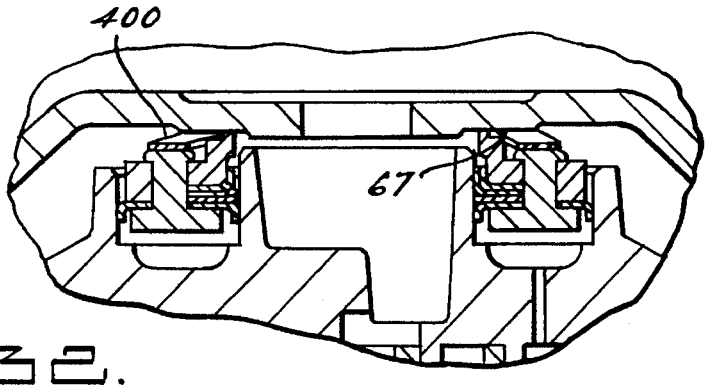
Fig. 32.

SCROLL COMPRESSOR DRIVE HAVING A BRAKE

CROSS REFERENCE TO RELATED APPLICATIONS

This application is a continuation-in-part of PCT application Ser. No. PCT/US93/06307, filed Jul. 2, 1993, which designated the United States as a continuation-in-part of U.S. application Ser. No. 07/970,485, filed Nov. 2, 1992, now abandoned.

BACKGROUND OF THE INVENTION

The present invention relates generally to scroll machines, and more particularly to the elimination of reverse rotation problems in scroll compressors such as those used to compress refrigerant in refrigerating, air-conditioning and heat pump systems.

SUMMARY OF THE INVENTION

Scroll machines are becoming more and more popular for use as compressors in both refrigeration as well as air conditioning and heat pump applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction pod toward a center discharge port. An electric motor is provided which operates to drive the orbiting scroll member via a suitable drive shaft.

Because scroll compressors depend upon a seal created between opposed flank surfaces of the wraps to define successive chambers for compression, suction and discharge valves are generally not required. However, when such compressors are shut down, either intentionally as a result of the demand being satisfied, or unintentionally as a result of power interruption, there is a strong tendency for the pressurized chambers and/or backflow of compressed gas from the discharge chamber to effect a reverse orbital movement of the orbiting scroll member and associated drive shaft. This reverse movement often generates objectionable noise or rumble and possible damage. Further, in machines employing a single phase drive motor, it is possible for the compressor to begin running in the reverse direction should a momentary power failure be experienced. This reverse operation may result in overheating of the compressor and/or other damage to the apparatus. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the "forward" direction. However, the discharge pressure will now increase to a point where the cycle is repeated. Such cycling may also result in damage to the compressor and/or associated apparatus.

A primary object of the present invention resides, in one embodiment, in the provision of a very simple and unique unloader cam which can be easily assembled into a conventional gas compressor of the scroll type without significant modification of the overall compressor design, and which functions at compressor shut-down to quickly stop and unload the orbiting scroll and to hold it in check so that the discharge gas can balance with the suction gas, thereby preventing discharge gas from driving the compressor in the reverse direction (other than the very small amount necessary for the functioning of the unloader cam), which in turn eliminates the normal shut-down noise associated with such reverse rotation.

A further object concerns the provision of such an unloader cam which can accommodate without damage extended powered reversal of the compressor, which can occur when a miswired three-phase motor is the power source.

Another object of the present invention resides, in an alternative embodiment, in the provision of an even simpler and unique shaft stop which can also be easily assembled in a conventional scroll compressor without significant modification of the overall compressor design, and which also functions at compressor shut-down to quickly stop the shaft and hold it in check (without unloading the orbiting scroll), thereby preventing reverse rotation and the attendant shut-down noise associated therewith.

Yet another object resides in the provision of such a shaft stop which will prevent powered reversal of the compressor when powered by a miswired three-phase motor. Related objects reside in the provision of such devices, which do not otherwise alter the operation of the compressor, which do not increase starting torque or in any way reduce efficiency, which are easily lubricated with the existing lubrication system, and which are inexpensive to fabricate and assemble.

Both of the primary embodiments of the present invention achieve the desired results utilizing a very simple device which is rotationally driven by the compressor running gear and which under the proper conditions frictionally engages a fixed wall of the bearing housing to physically prevent reverse rotation of the crankshaft and hence reverse orbital movement of the orbiting scroll member. In the first embodiment the device is an unloader cam which is journaled on the outside diameter of the orbiting scroll drive hub, and in the second embodiment the device is a shaft stop journaled on the upper end of the crankshaft.

There are also two further embodiments disclosed which facilitate starting with low-starting-torque motors.

These and other features of the present invention will become apparent from the following description and the appended claims, taken in conjunction with the accompanying drawings.

BRIEF DESCRIPTION OF THE DRAWINGS

FIGS. 21 through 27 are top plan views of a shaft stop forming a second embodiment of the present invention, shown in various operating positions;

FIGS. 29 and 30 illustrate the geometric relationship of two extreme positions of the pivot pad on the unloader cam;

FIGS. 31 and 32 are partial sectional views taken 90° apart of the top of a scroll compressor showing a modified floating seal arrangement;

DESCRIPTION OF THE PREFERRED EMBODIMENTS

Figures 1, 2:
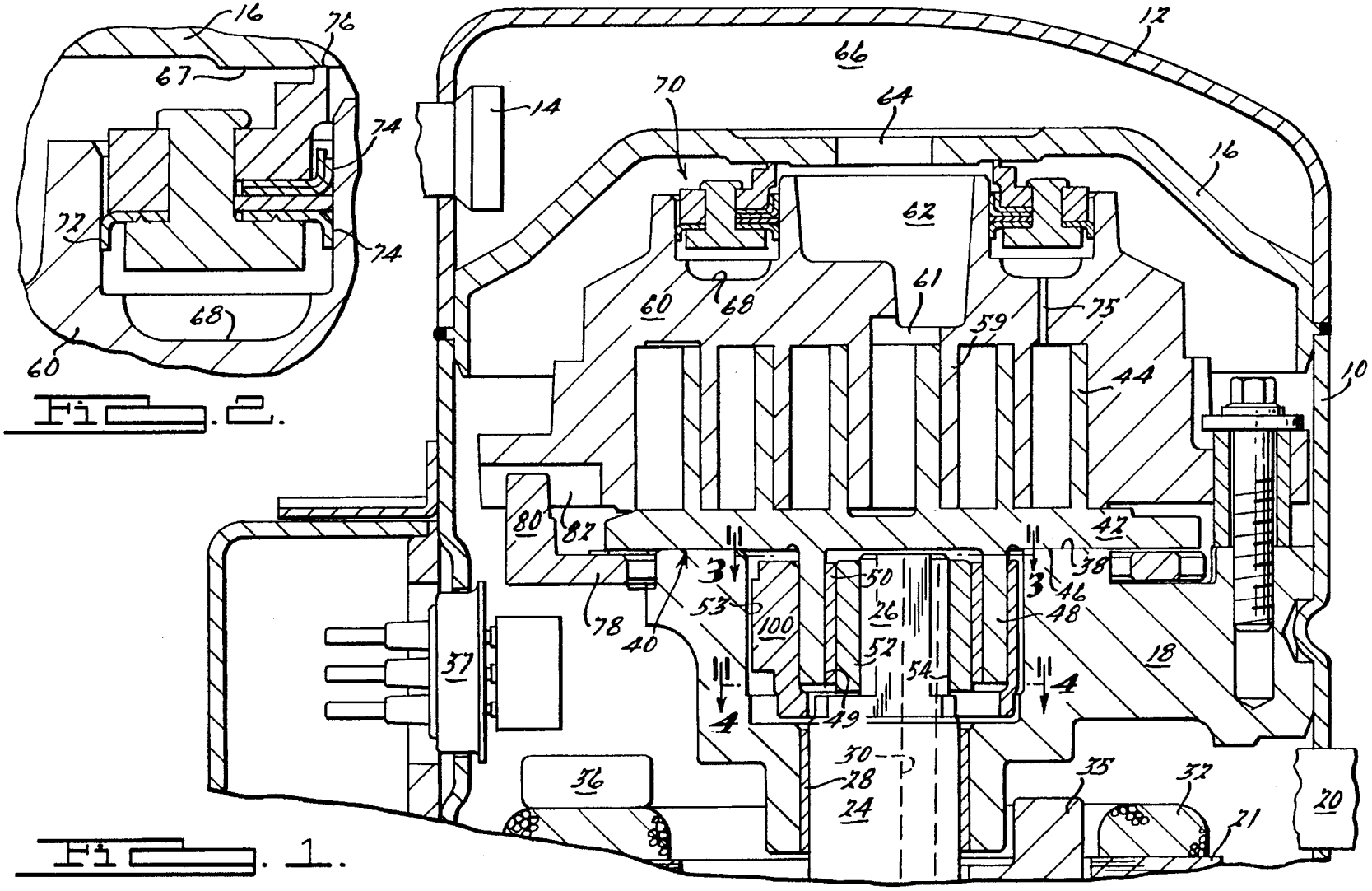
FIG. 1 is a partial vertical sectional view through the upper portion of a scroll compressor which incorporates a first embodiment of the present invention.
FIG. 2 is a fragmentary enlarged view of a portion of the floating seal illustrated in FIG. 1.

While the present invention is suitable for incorporation in many different types of scroll machines, for exemplary purposes it will be described herein incorporated in a scroll refrigerant compressor of the general structure partially illustrated in FIG. 1. Broadly speaking, the compressor comprises a generally cylindrical hermetic shell 10 having welded at the upper end thereof a cap 12, which is provided with a refrigerant discharge fitting 14 optionally having the usual discharge valve therein, and having a closed bottom (not shown). Other elements affixed to the shell include a generally transversely extending partition 16 which is welded about its periphery at the same point that cap 12 is welded to shell 10, a main bearing housing 18 which is affixed to shell 10 in any desirable manner, and a suction gas inlet fitting 20 in communication with the inside of the shell.

A motor stator 21 is affixed to shell 10 in any suitable manner. A crankshaft 24 having an eccentric crank pin 26 at the upper end thereof is rotatably journaled adjacent its upper end in a bearing 28 in bearing housing 18 and at its lower end in a second bearing disposed near the bottom of shell 10 (not shown). The lower end of crankshaft 24 has the usual relatively large diameter oil-pumping bore (not shown) which communicates with a radially outwardly inclined smaller diameter bore 30 extending upwardly therefrom to the top of the crankshaft. The lower portion of the interior shell 10 is filled with lubricating oil in the usual manner and the pumping bore at the bottom of the crankshaft is the primary pump acting in conjunction with bore 30, which acts as a secondary pump, to pump lubricating fluid to all of the various portions of the compressor which require lubrication.

Crankshaft 24 is rotatively driven by an electric motor including stator 21, windings 32 passing therethrough, and a rotor (not shown) press fit on crankshaft 24. A counterweight 35 is also affixed to the shaft. A motor protector 36 of the usual type may be provided in close proximity to motor windings 32 so that if the motor exceeds its normal temperature range the protector will de-energize the motor. Although the wiring is omitted in the drawings for purposes of clarity, a terminal block 37 is mounted in the wall of shell 10 to provide power for the motor.

Figure 5:
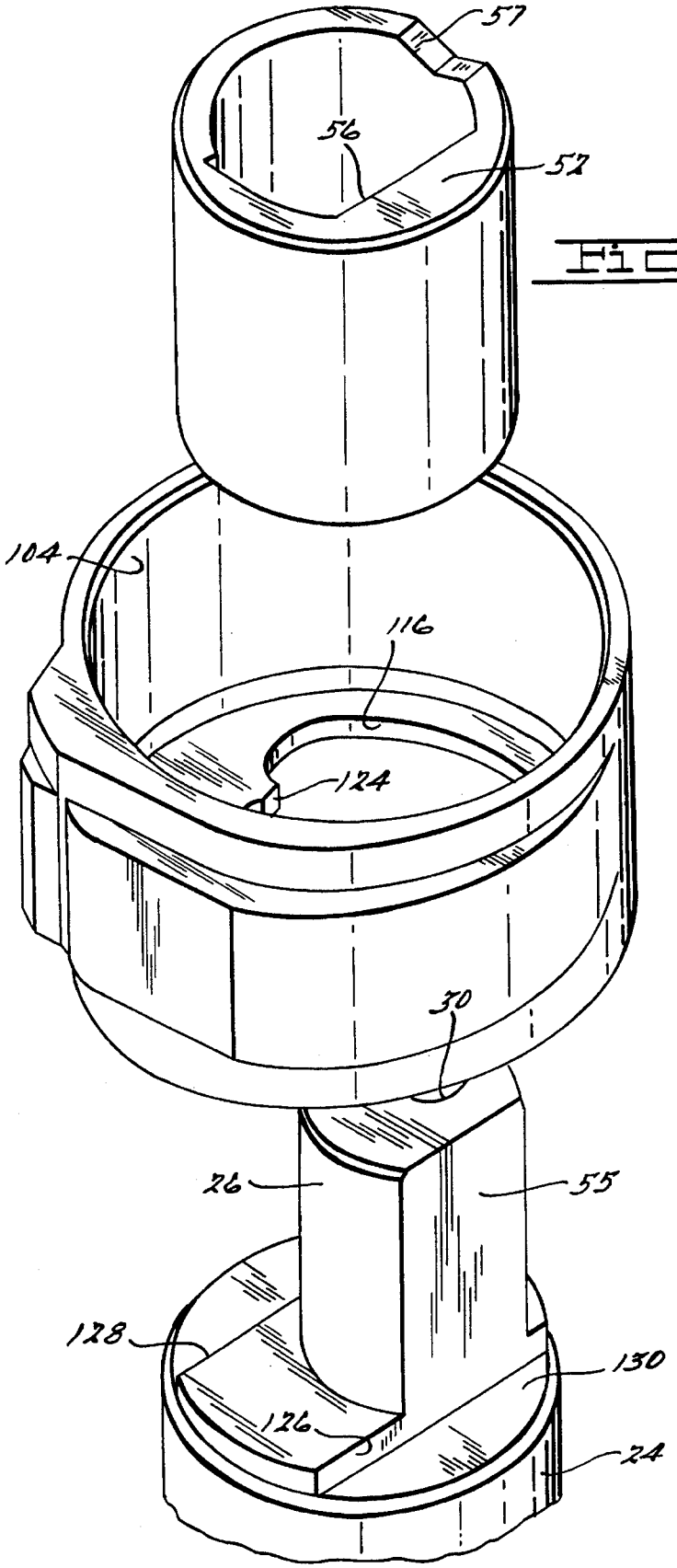
FIG. 5 is a perspective view showing the crank shaft and pin, unloader cam and drive bushing of the present invention.
Figure 6:
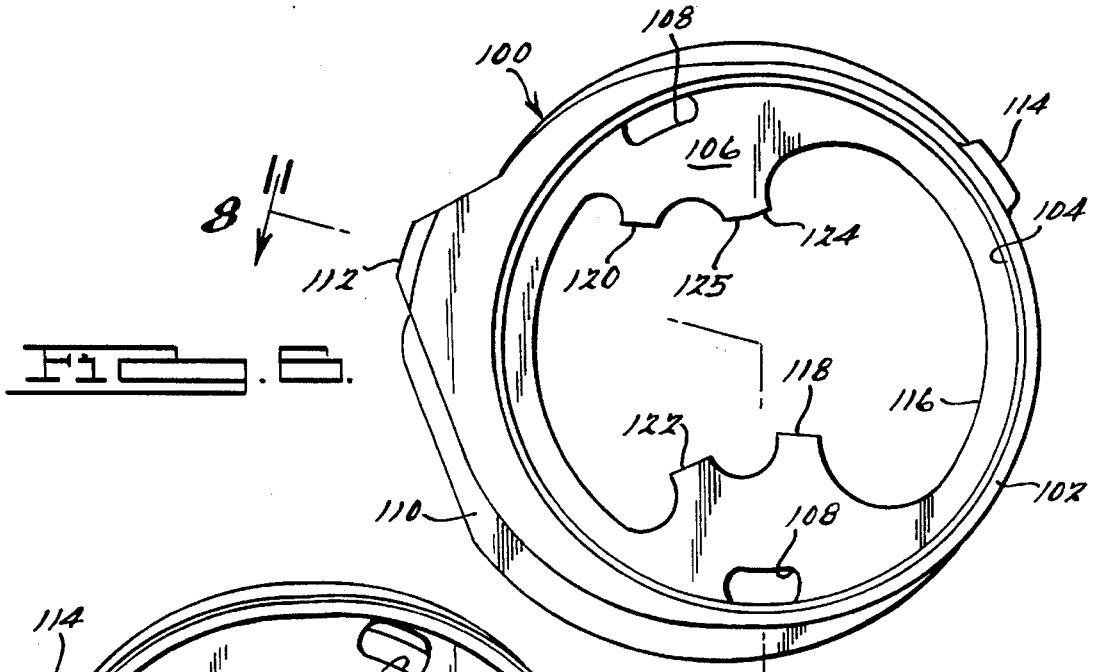
FIG. 6 is a top elevational view of an unloader cam embodying the principles of the first embodiment of the present invention.
Figure 7:
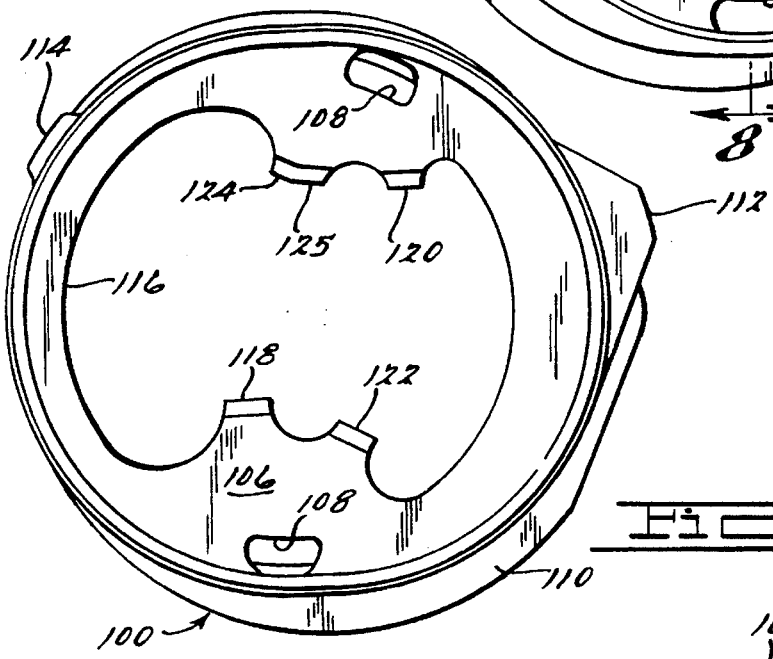
FIG. 7 is a bottom elevational view of the unloader cam of FIG. 6.
Figure 8:
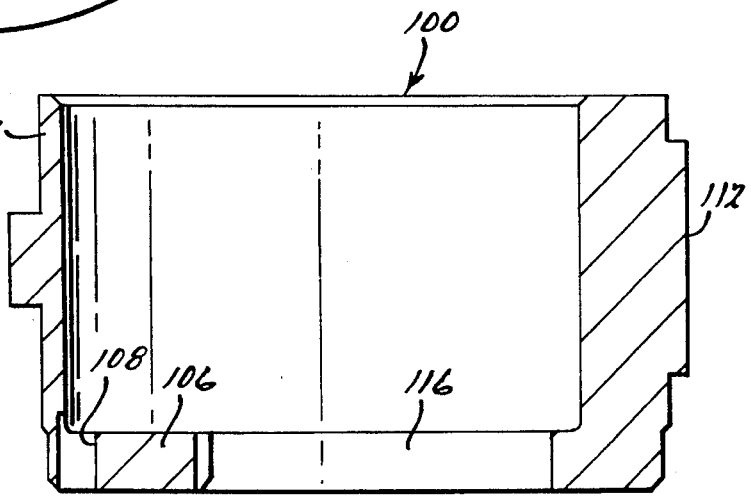
FIG. 8 is a sectional view taken along line 8—8 in FIG. 6.

The upper surface of main bearing housing 18 is provided with an annular flat thrust bearing surface 38 on which is disposed an orbiting scroll member 40 comprising an end plate 42 having the usual spiral vane or wrap 44 on the upper surface thereof, an annular flat thrust surface 46 on the lower surface thereof engaging surface 38, and projecting downwardly therefrom a cylindrical hub 48 having an outer cylindrical surface 49 and an inner journal bearing 50 in which is rotatively disposed a drive bushing 52 having an inner bore 54 in which crank pin 26 is drivingly disposed. Crank pin 26 has a flat surface 55 which drivingly engages a flat surface 58 in bore 54 (FIGS. 3 and 5) to provide a radially compliant driving arrangement for causing orbiting scroll member 40 to move in an orbital path, such as shown in applicants' assignee's U.S. Pat. No. 4,877,382, the disclosure of which is hereby incorporated herein by reference. Hub 48 has an outer circular cylindrical surface and is disposed within a recess in bearing housing 18 defined by a circular wall 53 which is concentric with the axis of rotation of crankshaft 24.

Lubricating oil is supplied to bore 54 of bushing 52 from the upper end of bore 30 in crankshaft 24. Oil thrown from bore 30 is also collected in a notch 57 on the upper edge of bushing 52 from which it can flow downwardly through a connecting passage created by a flat 58 on the outer surface of bushing 52 for the purpose of lubricating bearing 50. Additional information on the lubrication system is found in the aforesaid U.S. Pat. No. 4,877,382.

Wrap 44 meshes with a non-orbiting spiral wrap 59 forming a part of non-orbiting scroll member 60 which is mounted to main bearing housing 18 in any desired manner which will provide limited axial (and no rotational) movement of scroll member 60. The specific manner of such mounting is not critical to the present invention, however, in the present embodiment, for exemplary purposes, non-orbiting scroll member 60 is mounted in the manner described in detail in applicants' assignee's U.S. Pat. No. 5,102,316, the disclosure of which is hereby incorporated herein by reference.

Non-orbiting scroll member 60 has a centrally disposed discharge passageway 61 communicating with an upwardly open recess 62 which is in fluid communication via an opening 64 in partition 16 with the discharge muffler chamber 66 defined by cap 12 and partition 16. The entrance to opening 64 has an annular seat portion 67 therearound. Non-orbiting scroll member 60 has in the upper surface thereof an annular recess 68 having parallel coaxial side walls in which is sealingly disposed for relative axial movement an annular floating seal 70 which serves to isolate the bottom of recess 68 from the presence of gas under suction pressure at 72 and discharge pressure at 74 so that it can be placed in fluid communication with a source of intermediate fluid pressure by means of a passageway 75 (FIGS. 1 and 2). The non-orbiting scroll member is thus axially biased against the orbiting scroll member to enhance wrap tip sealing by the forces created by discharge pressure acting on the central portion of scroll member 60 and those created by intermediate fluid pressure acting on the bottom of recess 68. Discharge gas in recess 62 and opening 64 is also sealed from gas at suction pressure in the shell by means of seal 70 at 76 acting against seat 67 (FIGS. 1 and 2). This axial pressure biasing and the functioning of floating seal 70 are disclosed in greater detail in applicants' assignee's U.S. Pat. No. 5,156,539, the disclosure of which is hereby incorporated herein by reference.

Relative rotation of the scroll members is prevented by an Oldham coupling comprising a ring 78 having a first pair of keys 80 (one of which is shown) slidably disposed in diametrically opposed slots 82 (one of which is shown) in scroll member 60 and a second pair of keys (not shown) slidably disposed in diametrically opposed slots (not shown) in scroll member 40 displaced 90° from slots 82, as described in detail in applicant's assignee's copending application Ser. No. 591,443, filed Oct. 1, 1990, the disclosure of which is hereby incorporated herein by reference.

The compressor is preferably of the "low side" type in which suction gas entering via fitting 20 is allowed, in part, to escape into the shell and assist in cooling the motor. So long as there is an adequate flow of returning suction gas the motor will remain within desired temperature limits. When this flow ceases, however, the loss of cooling will cause motor protector 36 to trip and shut the machine down.

The scroll compressor as thus far broadly described is either now known in the art or is the subject matter of other pending applications for patent or patents of applicants' assignee.

As noted, both of the primary embodiments of the present invention utilizes a very simple stop device which is rotationally driven by the crankshaft and which under the proper conditions functionally engages wall 53 of bearing housing 18 to physically prevent reverse rotation of the crankshaft and hence reverse orbital movement of the orbiting scroll member. Wall 53 therefore constitutes a braking surface in the context of this invention. In the first embodiment the stop device is an unloader cam which is journaled on the outside diameter of hub 48, and in the second surface the stop device is a shaft stop journaled on the upper end of the crankshaft. It is believed that all primary embodiments of the present invention are fully applicable to any type of scroll compressor utilizing orbiting and a non-orbiting scroll wraps, without regard to whether there is any pressure biasing to enhance tip sealing.

The first embodiment is illustrated in FIGS. 1 through 18 and the cam, indicated at 100, is best seen in FIGS. 4 through 8. Cam 100 is generally cup-shaped in overall configuration, comprising a cylindrical side wall 102, having a circular cylindrical inside surface 104 journaled with a small clearance (not shown) on the outside diameter of hub 48, and a generally flat bottom wall 106 having a pair of drain holes 108 for draining lubricant and foreign matter. One portion of wall 102 is provided with a thickened portion 110 for the purposes of positioning the center of gravity at the desired position (FIG. 9), and integrally formed on portion 110 is a stop pad 112 adapted to frictionally engage brake surface 53 to prevent reverse rotation, as will be described in detail with reference to FIGS. 9 through 13. Generally opposite stop pad 112 is an integrally formed pivot pad 114 also adapted to engage brake surface 53 at certain times during the operation of the device.

Bottom wall 106 of cam 100 is provided with an irregularly shaped opening 116 which defines five separate relatively flat driven surfaces 118, 120, 122, 124 and 125, which are adapted to be driven by relatively parallel drive surfaces 126 and 128 formed at the top of crankshaft 24 at the base of crank pin 26. Cam 100 rests on the generally flat top 130 of crankshaft 24 with drive surfaces 126 and 128 engaging driven surfaces 118 and 120, respectively, in the forward direction of relative rotation, and with drive surfaces 126 and 128 engaging driven surfaces 122 and 124 or 125, respectively, in the reverse direction of relative rotation. The result is essentially a lost motion positive drive connection between the cam and crankshaft.

Cam 100 functions at compressor shutdown by unloading orbiting scroll member 40 and holding it in check while allowing discharge gas to balance with suction gas. In doing so, the cam prevents discharge gas from driving the compressor in reverse, and thus eliminates the associated shutdown noise.

Figure 9:
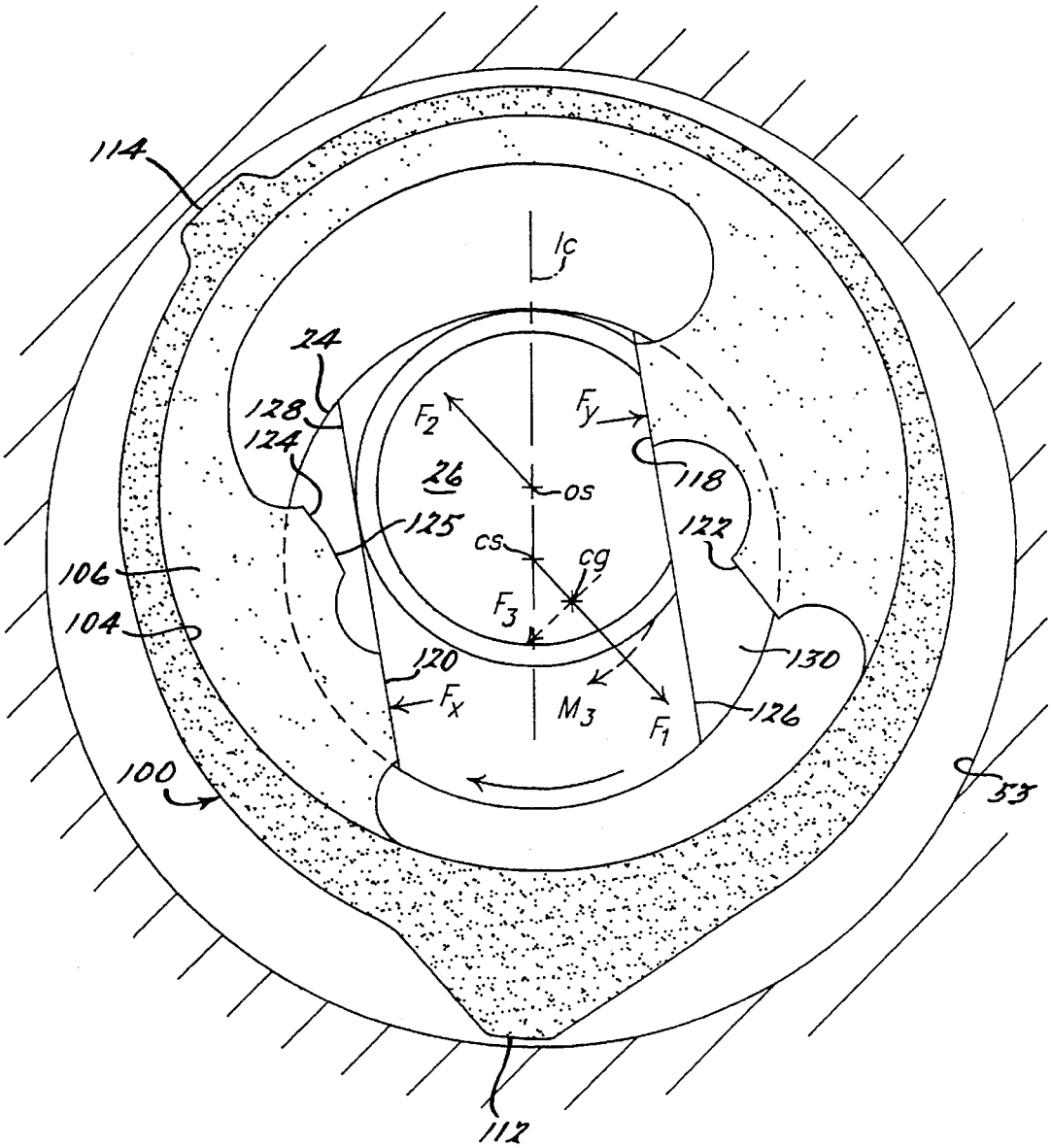
FIGS. 9 through 18 are diagrammatic illustrations of how the unloader cam embodiment of the present invention functions in various stages of operation.
Figure 10:
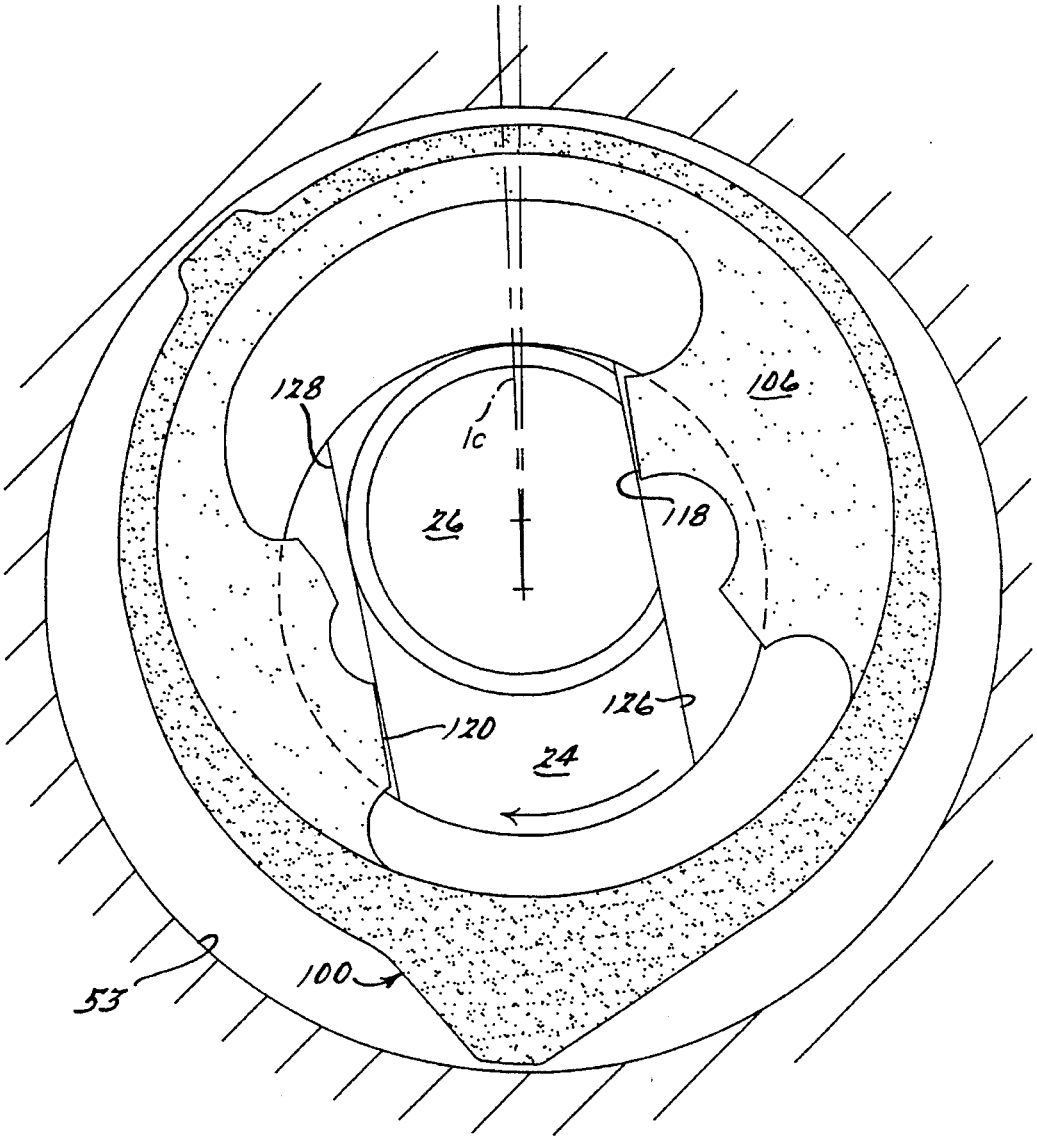

FIG. 9 shows the components in their "normal operating" positions and the forces which maintain these positions. In FIG. 9 the center of crank pin 26 and scroll hub 48 is indicated at os and the center of rotation of crankshaft 24 and the center of braking surface 53 is indicated at cs. The line of centers of os and cs is shown at lc. During operation, cam 100 rotates clockwise (as shown) with crankshaft 24 and by design, is driven by the shaft via driven surfaces 118 and 120. Consequently, there is relative rotational motion between cam 100 and scroll hub 48 (which orbits) and braking surface 53 (which is stationary). Because of this relative motion, metal contact between the cam and other two components would cause unnecessary drag and wear, and need be avoided. This is accomplished by locating the cam center of gravity cg in a position such that the centrifugal load produces a counterclockwise moment as shown in FIG. 9. This counterclockwise moment keeps cam 100 rotationally loaded against drive shaft 24 and consequently keeps pivot pad 114 from dragging along braking surface 53. As shown in FIG. 9, $F_1$ is the radial centrifugal force on cam 100 radially from the center axis cs of crankshaft 24. $F_1$ is balanced by an equal reaction force $F_2$ through the center axis os of crank pin 26. Because $F_1$ and $F_2$ are slightly offset (by properly locating the center of gravity of the cam) a counterclockwise moment is created on the cam. This counterclockwise moment is balanced by a clockwise moment produced by reactions $F_x$ and $F_y$ which causes it to remain in the position of FIG. 9 during normal operation. Because the tangential gas load is not necessarily constant, the compressor can experience a slight acceleration and deceleration each revolution, which in turn produces an alternating rotational moment on the unloader cam. Consequently, this counterclockwise moment (created by offset forces $F_1$ and $F_2$) must be of sufficient magnitude to keep forces $F_x$ and $F_y$ greater than zero, and thereby prevent the unloading of surfaces 118 and 120 that could produce unnecessary noise.

Figure 11:
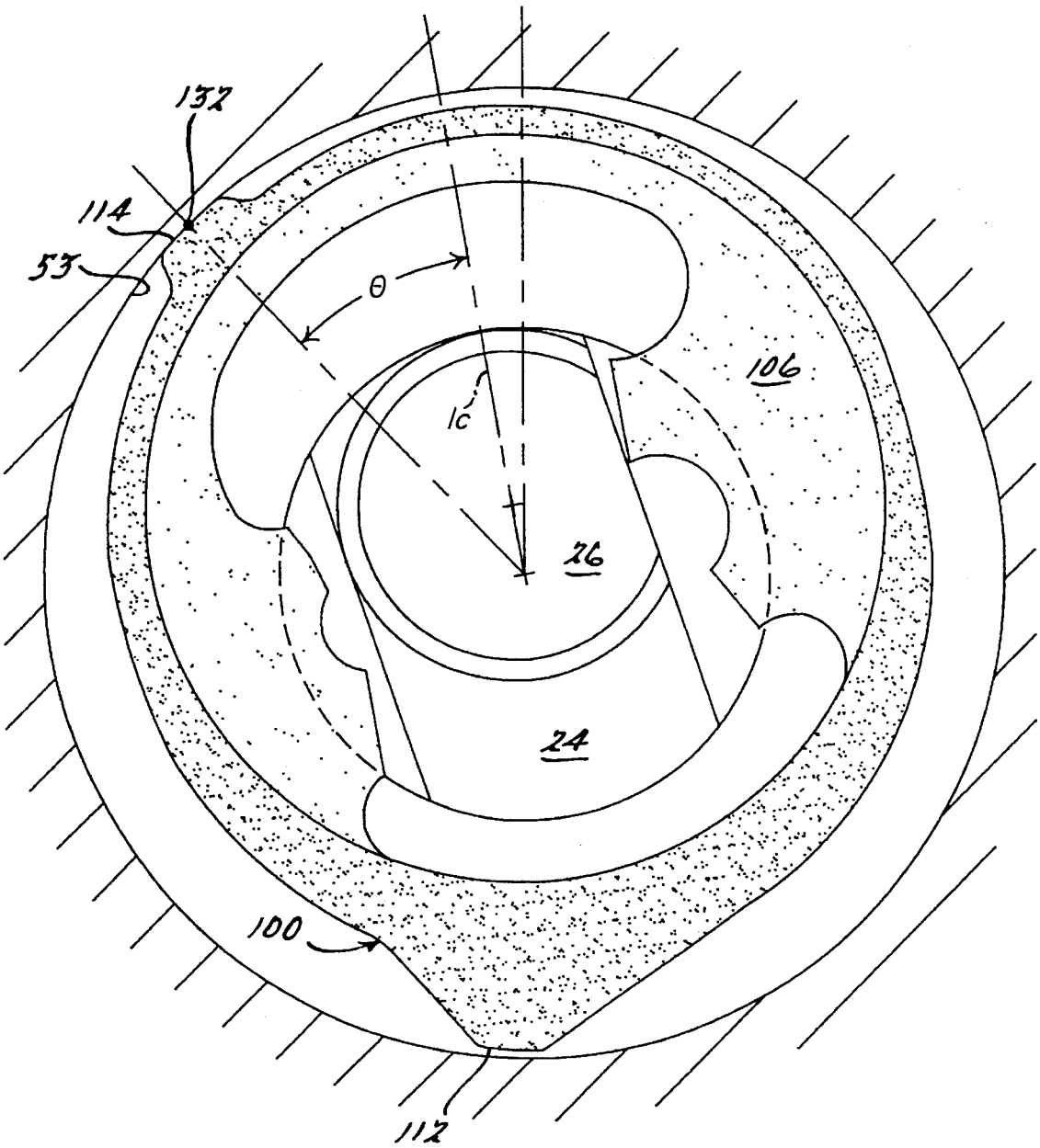

At compressor shut down, an angular deceleration is introduced, which in turn produces a clockwise moment on the cam. This clockwise moment has two components, one associated with the cam mass, and the other associated with the cam rotational inertia. The introduction of these two new components to the force diagram of FIG. 9 is shown in dotted lines. The mass associated moment is termed $F_3$ and acts clockwise at cg, and the inertia associated moment is termed $M_3$ and also acts clockwise on the cam. Initially centrifugal force $F_1$ was used to create a counterclockwise moment; however, while the counterclockwise moment caused by $F_1$ decreases as the angular velocity decreases, the clockwise moment caused by $F_3$ and $M_3$ remains virtually constant. At some time during deceleration, the counterclockwise moment becomes less than the clockwise moment, and the cam rotates slightly clockwise away from the drive means (see the space between surfaces 118 and 126 and between surfaces 128 and 120 FIG. 10) until eventually the pivot pad 114 contacts and drags along braking surface 53, as shown at 132 in FIG. 11. This condition can exist for several forward revolutions of the crank. The cam is now in position to unload the orbiting scroll when the compressor finally stops coasting forward and just begins to rotate in reverse. FIG. 11 thus shows the components in their "pivot pad engagement" positions.

Figure 12:
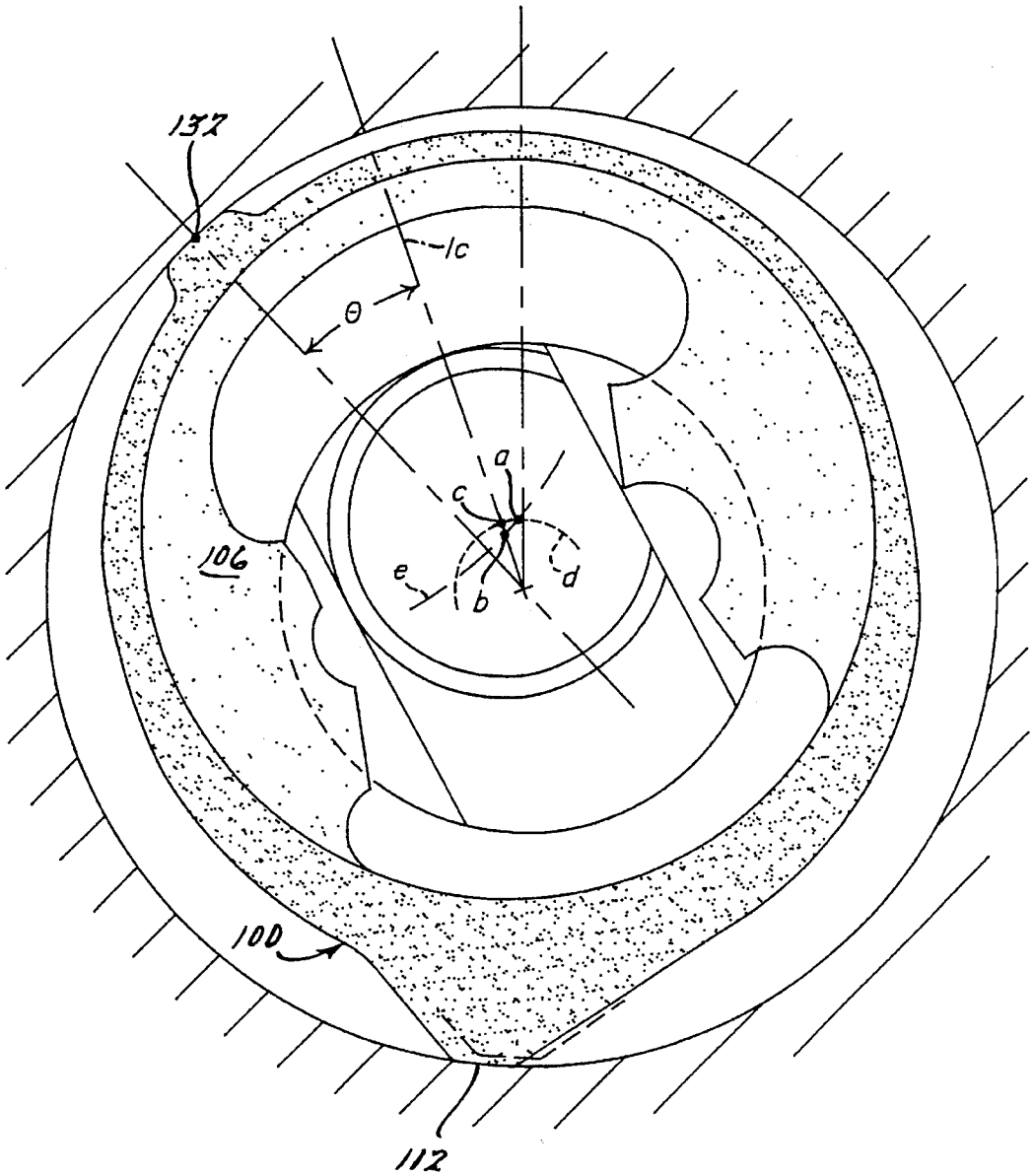

FIG. 12, represents the "flipped" position of the components. The same tangential gas force which slowed and stopped the compressor forward motion now causes a slight reverse motion starting at a. The orbiting scroll member's normal path of movement would be from point a to point c and beyond along path d defined by its orbiting radius, but because of the engagement of pivot pad 114 with surface 53 the orbiting scroll member is forced to move along path e (centered on the cam pivot point 132) to point b at which time pad 112 engages surface 53. The distance between points b and c along line lc (FIG. 12) is the gap which is created between the orbiting scroll member wraps and those of the non-orbiting scroll member. This gap unloads the compressor by permitting gas at discharge pressure to flow back through the compressor to a zone of gas at suction pressure. The "flip" which creates the gap is caused by the initial reverse rotation of the orbiting scroll member by the tangential discharge gas force.

Figure 13:
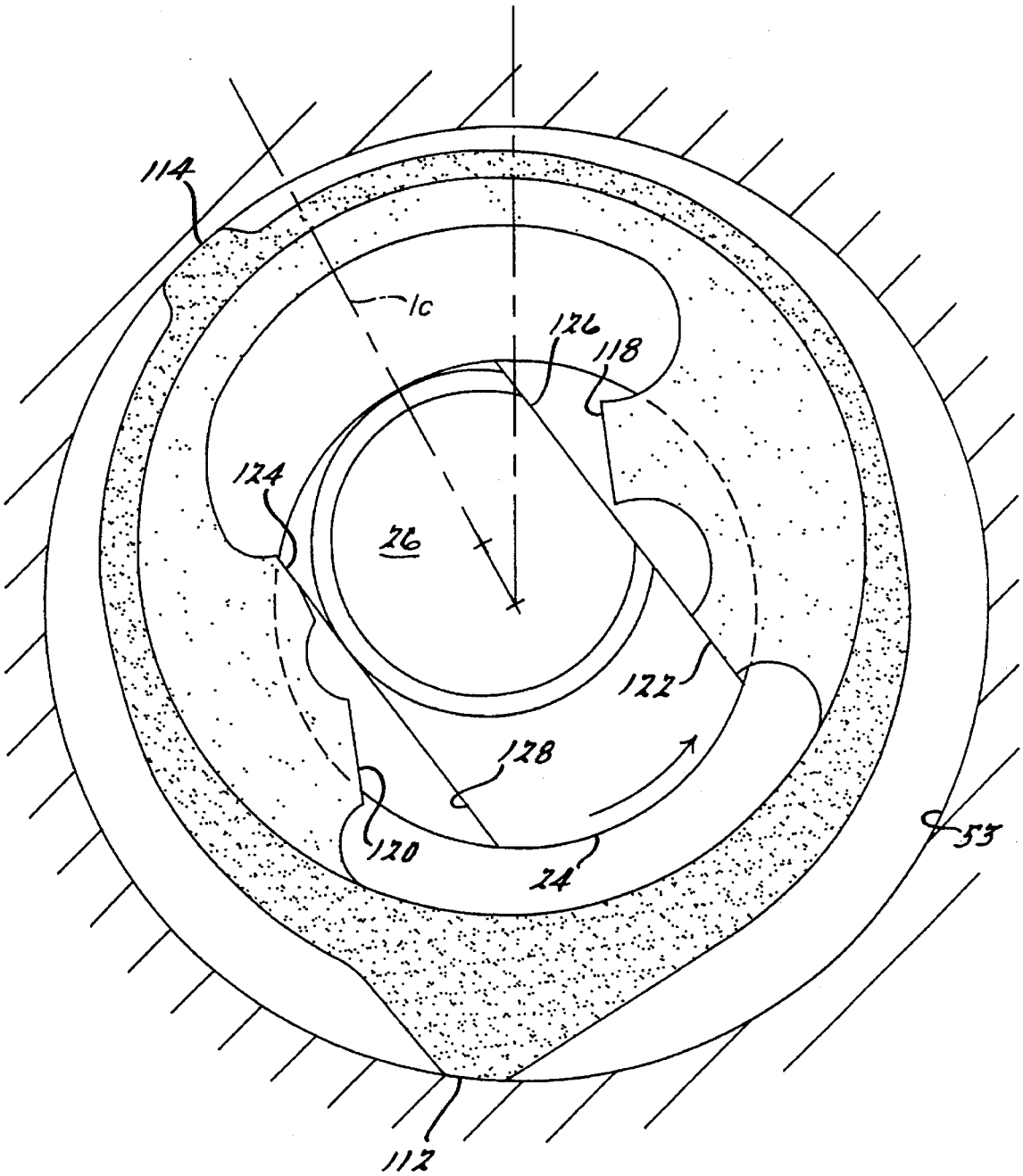

The location of the pivot pad as defined by pivot angle $\Theta$ in FIGS. 11 and 12 is important to the functioning of the cam and is a trade-off between available wall 63 friction and the kinetic energy developed in the running gear. FIGS. 29 and 30 demonstrate the differences between a large and small pivot angle $\Theta$. A small angle (FIG. 29) requires the orbiting scroll member to travel a longer distance on path e before the desired flank separation b to c is achieved. Associated with this longer distance is more kinetic energy in the scroll, drive bushing, cam and shaft which must be dissipated through impact and friction. Conversely, a large angle (FIG. 30) requires a greater coefficient of wall friction to induce the cam to function properly. This required wall friction is proportional to the magnitude of angle $\Theta$, which increases as pivot angle e increases. Should angle $\Theta$ be too large, the required wall coefficient of friction may be greater than what is available. Should angle $\Theta$ be too small, an unacceptable amount of kinetic energy may lead to impact damage. When flank separation reaches a predetermined clearance (sufficient to let discharge gas flow back to suction, i.e., approximately 0.010 inches) the cam stop pad 112 impacts and stops against wall surface 53 (FIG. 12), quickly dissipating the energy in the orbiting scroll, drive bushing, and unloader cam itself, although the shaft is still turning in the reverse direction. The energy built up in these three components during the slight reversing of the compressor necessary to make the cam function is small compared to the energy built up in the shaft. The energy in the shaft must also be dissipated, and this can be done by either impact or friction. By using impact, the back side of crank pin 26 (opposite drive surface 55) is allowed to hit the already stopped drive bushing. By using friction (the preferred way to dissipate shaft energy) a different approach is taken. Before impact of the crank pin with the already stopped drive bushing occurs, the crankshaft drive surfaces 126 and 128 engage the driven surfaces 122 and 124 on unloader cam 100 and turn it in reverse (FIG. 13). However, cam 100 is pinned between scroll hub 48 and wall surface 53 at both pivot and stop pads 114 and 112. The friction at these pads is thus used to dissipate shaft energy as the shaft tries to rotate the cam in reverse. The cam need only turn 10°–15° along wall surface 53 before stopping the shaft.

Another consideration in the design of the cam is its ability to not be damaged or cause damage in the event the compressor is powered by a miswired three-phase motor, which would cause it to be powered in the reverse direction. The case of powered reversal is subtly, but significantly, different than the normal reverse at shutdown. While the unloader cam prevents reverse rotation at normal shut down, on powered reverse it allows reverse rotation so that the compressor will run inefficiently, overheat and trip the motor protector without damage. A powered reverse is initiated by the shaft, which in turn causes sequential motion in the other components (unloader cam, drive bushing and orbiting scroll member), whereas a normal reverse at shutdown is initiated by the tangential gas force driving all the components (orbiting scroll member, drive bushing, shaft and unloader cam) simultaneously in reverse.

Figure 14:
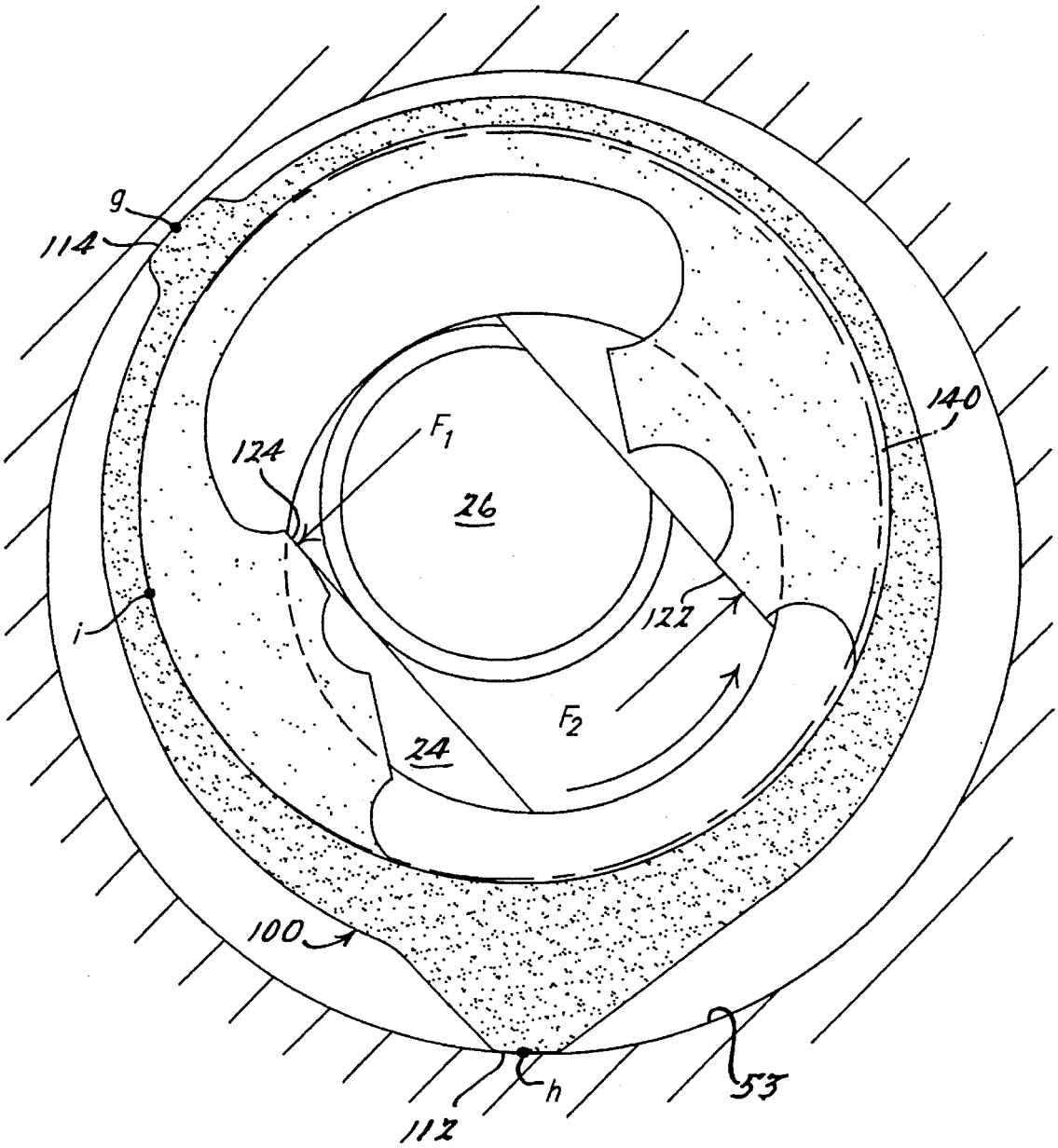

FIG. 14 shows initiation of powered reversal with the unloader cam in the position it would be in after a normal stop (it could be in any number of other positions at the start of powered reversal with the same net results as described herein). FIG. 14 shows contact of both pads on braking surface 53, and contact between the unloader cam and scroll hub at points g, h, and i respectively. Note that a small clearance (exaggerated in the drawing) exists between cam 100 and hub 48, as shown at 140. This clearance, in the order of 0.015 inches aids in the functioning of the cam during powered reverse. In addition, the shaft is shown exerting forces $F_1$ and $F_2$ on the unloader cam at cam pads 124 and 122 respectively. Only the shaft and unloader cam are beginning to rotate counterclockwise. This is pure rotation of the shaft and unloader cam as a unit about the shaft center line, with both pads merely drag along wall surface 53.

Figure 15:
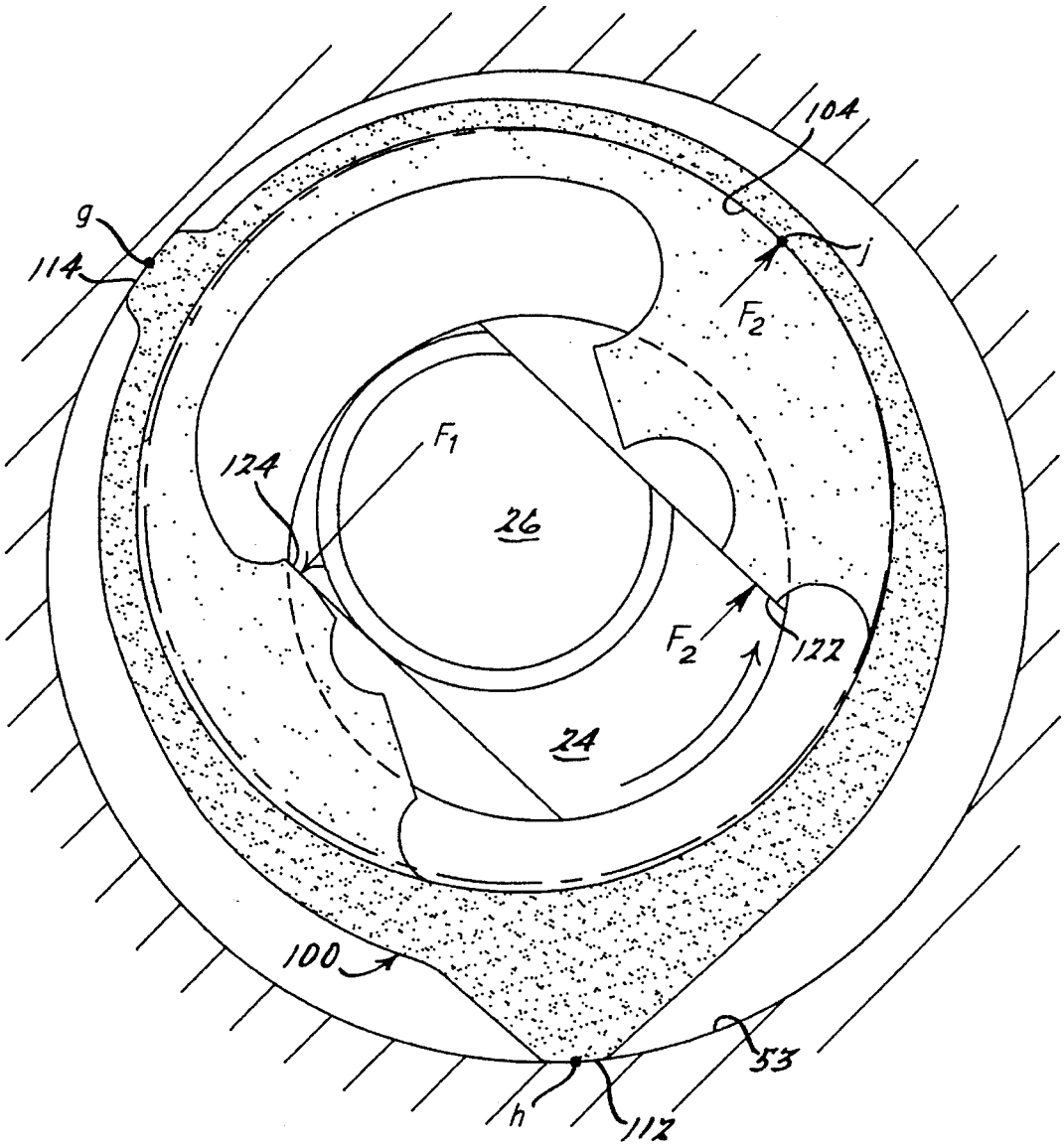

FIG. 15 shows the result of several degrees counterclockwise rotation. Contact point i has become a clearance and a contact point j between the unloader cam and the scroll hub appears (i.e., the contact point shifts). Force $F_2$ is now in a transition stage, partially acting on pad 122 and partially on surface 104 at point j of the unloader cam.

Figure 16:
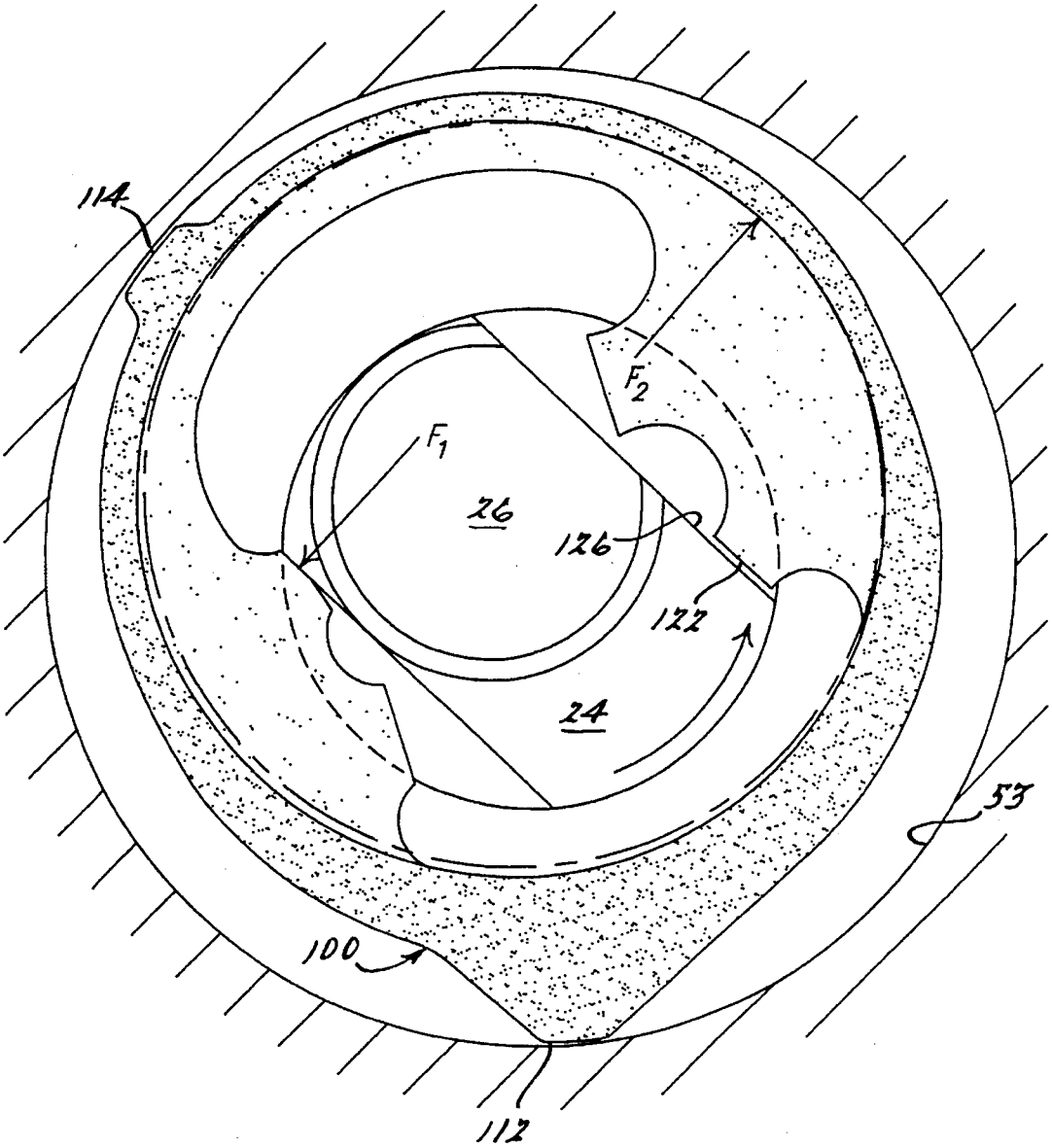
Figure 17:
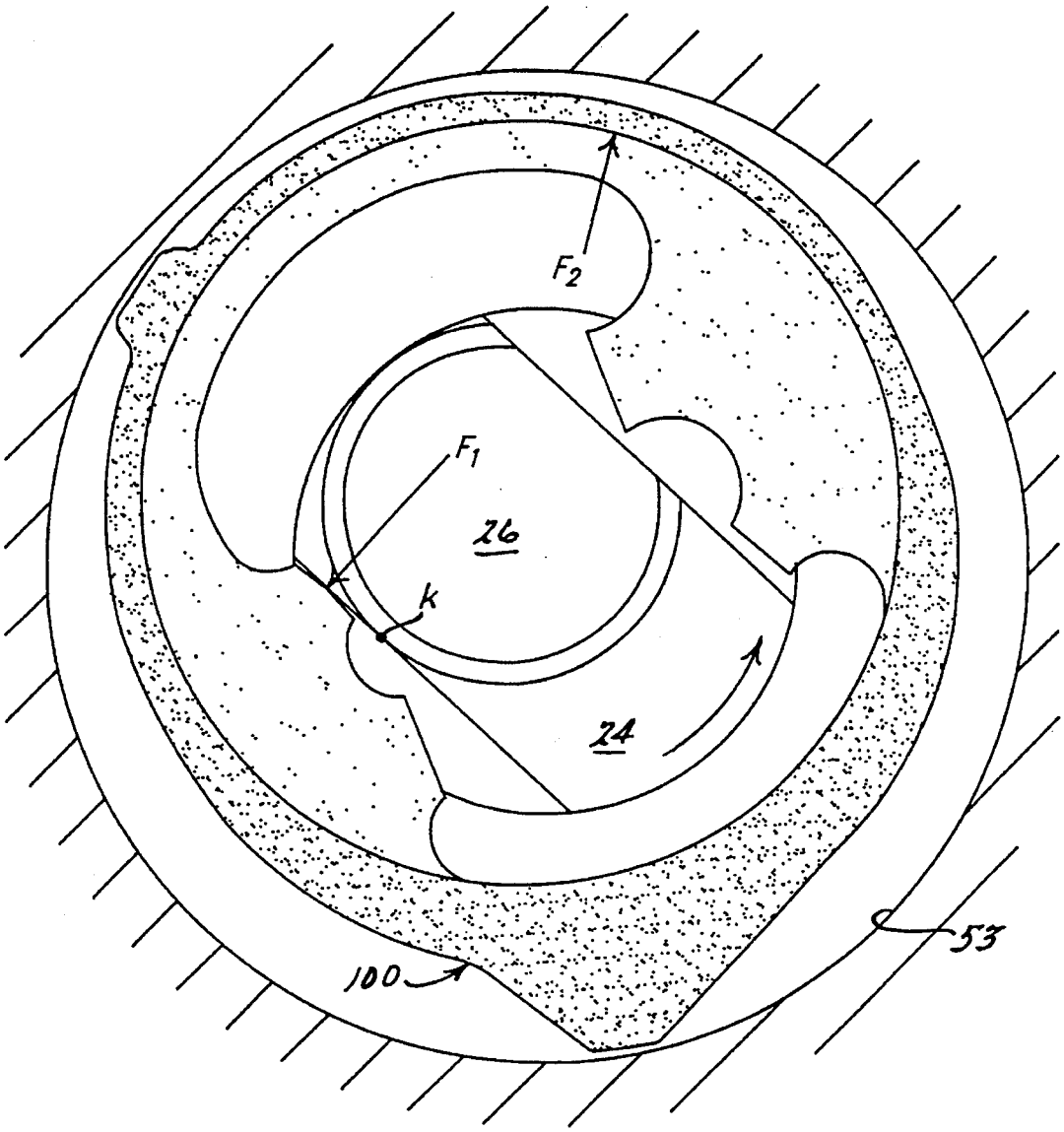
Figure 18:
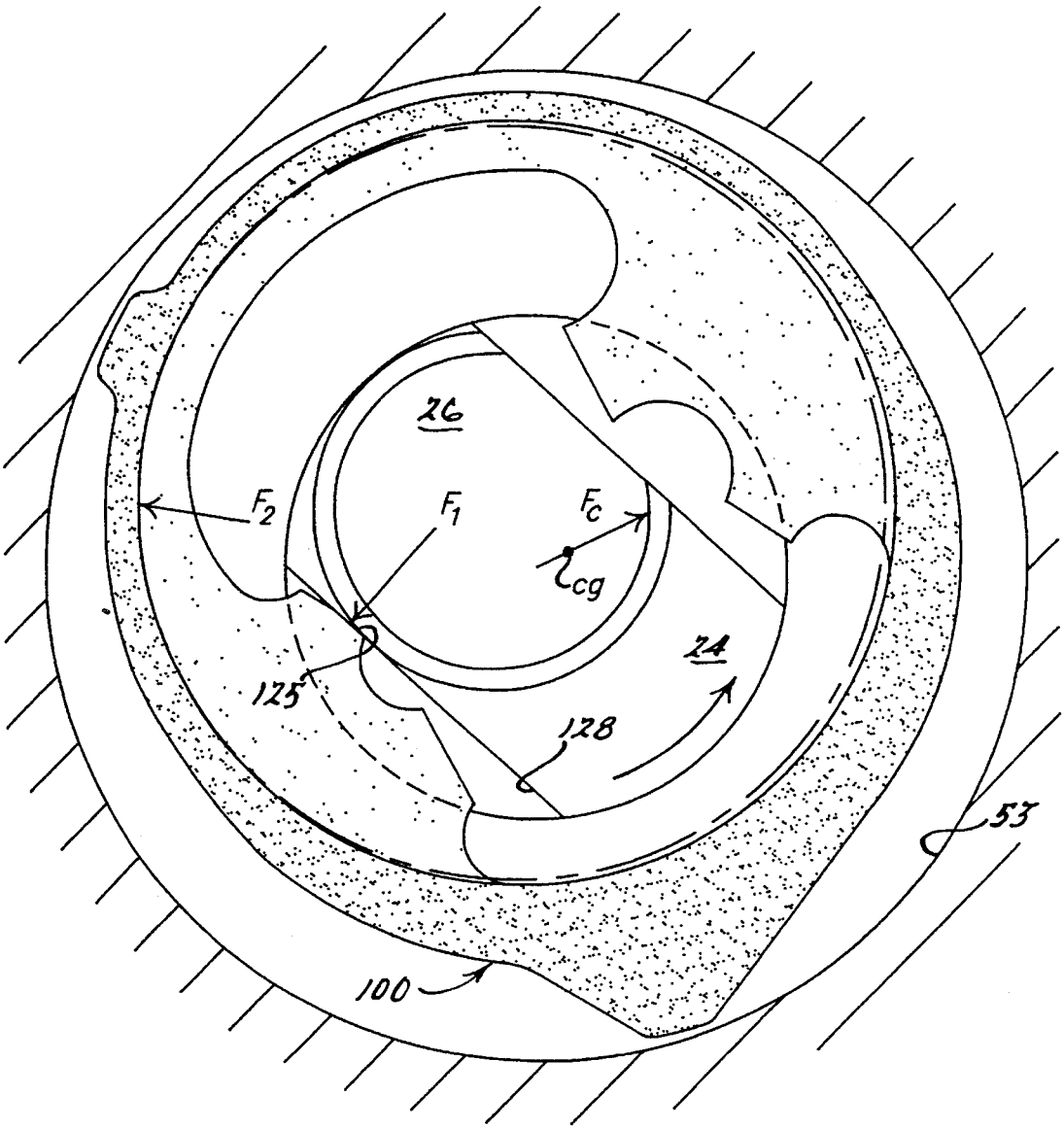

FIG. 16 shows continued rotation of the shaft after the transition of $F_2$ to unloader cam wall 104. The magnitude of $F_2$ (which is acting equally on the scroll hub 48 as it is on the cam) is insufficient to create any scroll motion because of the mass of the scroll. However, coupled with force $F_1$, these forces do produce a moment which now rotates the unloader cam about the yet unmoving scroll hub (see the separation of surfaces 122 and 126). This rotation serves to separate unloader cam pads 114 and 112 away from wall surface 53. After adequate separation between pads 112 and 114 and wall surface 53 is achieved, the shaft back of crank pin 26 engages the drive bushing at point k as shown in FIG. 17. This engagement signifies the onset of drive bushing and orbiting scroll member movement. With all components moving in reverse, force ($F_2$) slowly drifts from its original position (FIG. 16) to its final position (FIG. 18) as rotational velocity increases. FIG. 18 shows steady state forces on the cam as the compressor is powered in reverse. Sufficient rotational velocity has produced centrifugal force $F_c$ acting at cg. This centrifugal force causes the cam to rotate slightly more about the orbiting scroll hub inducing force $F_1$ to move from unloader cam pad 124 to pad 125. This further increases clearances between unloader cam surfaces 112 and 114 and wall 53. Significant clearances are maintained between the cam and walls by the centrifugal force $F_c$ and the forces are in equilibrium with drive surface 128 engaging driven surface 125 (its slight relief from surface 124 increases the gap between the pads and the braking surface).

Figure 19:
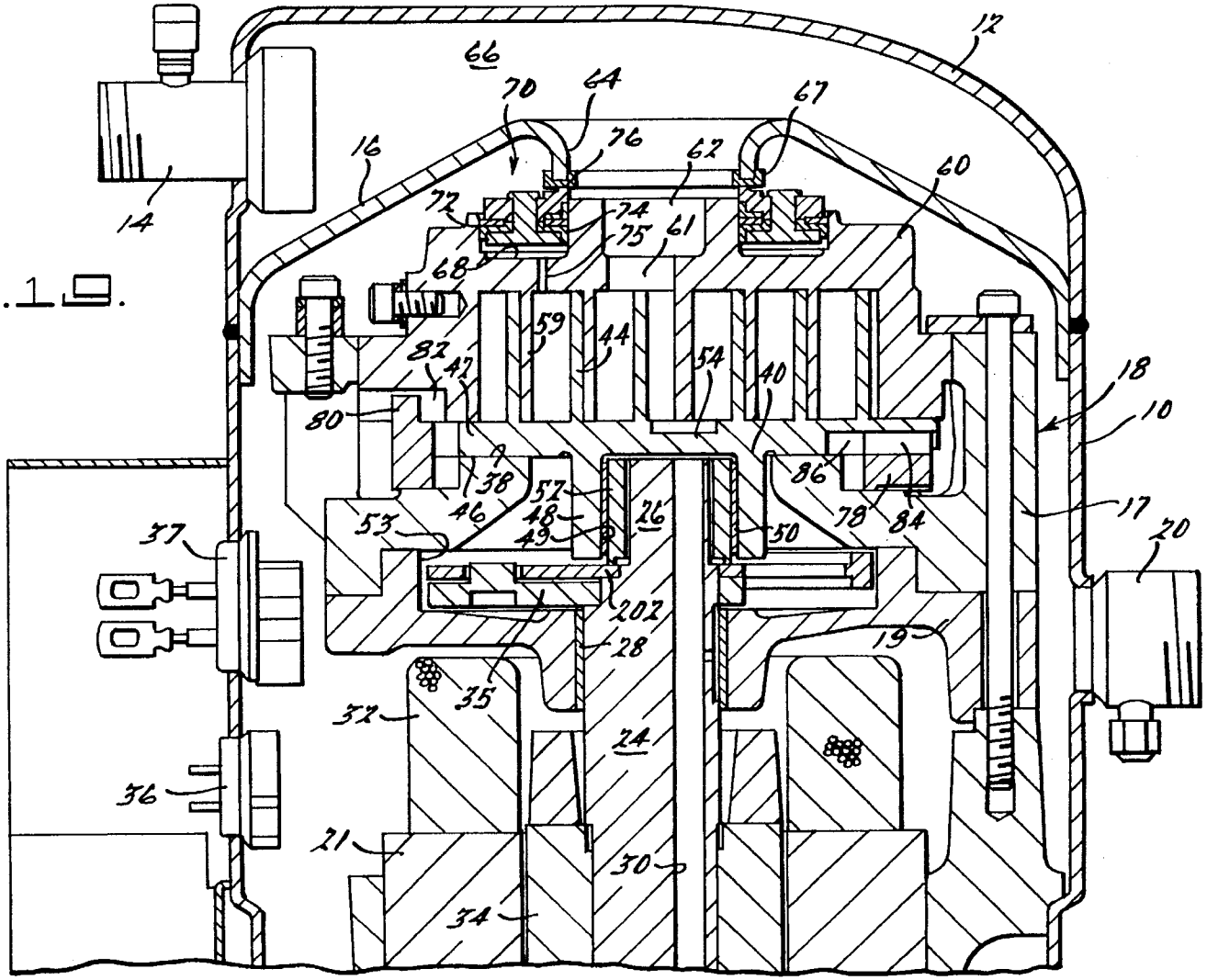
FIG. 19 is a view similar to FIG. 1 illustrating a scroll compressor incorporating a second embodiment of the present invention.

The second primary embodiment of the present invention utilizes a simple but unique shaft stop to prevent reverse rotation. The compressor incorporating this embodiment is illustrated in FIG. 19. This compressor is generally similar to that of FIG. 1, at least insofar as the present invention is concerned, and like reference numerals are used to identify similar parts. The significant differences are that several parts are configured differently, the most notable being that bearing housing 18 is now formed from separate upper and lower housing portions 17 and 19, respectively, with the shaft stop 200 and counterweight 35 of the present invention being disposed therebetween and above crank bearing 28. The bearing housing design, as well as the new way the non-orbiting scroll is mounted, are described in detail in applicants' assignee's co-pending application Ser. No. 863, 949, filed Apr. 6, 1992, the disclosure of which is hereby incorporated herein by reference. In addition, one of the second pair of Oldham keys is shown at 84 disposed in a slot 86 in orbiting scroll member 40 (the right hand portion of Oldham ring 78 is shown in FIG. 19 at a 90° position with respect to its left hand end).

Figure 20:
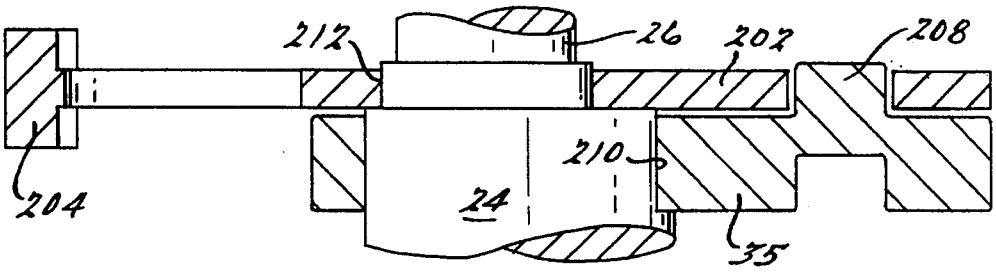
FIG. 20 is a sectional view taken along line 20—20 in FIG. 21.

Shaft stop mechanism 200 (best shown in FIGS. 20 and 21) comprises a diametrically arranged generally flat hardened steel shaft stop 202 of the shape shown, having at one end an integral vertically disposed stop pad 204 normally slightly spaced from brake surface 53 but adapted to frictionally engage same in operation. Near its opposite radial end shaft stop 202 is provided with a circumferential notch 206 in which is disposed a pin 208 forming part of counterweight 35, which is affixed to crankshaft 24 and driven by a flat 210 thereon. The counterweight may be formed by fine blanking, with pin 208 being integrally formed. Shaft stop 202 is shaped to have its center of gravity located at cg and is mounted on a shoulder 212 on crankshaft 24 concentric with the axis of pin 26 for relative rotation therewith.

The shaft stop functions very similarly to the unloader cam but in a much simpler manner. Its sole purpose is to keep the shaft from rotating in reverse at both normal shutdown and powered reverse. It does not induce flank separation to unload the scrolls. The orbiting scroll member and drive bushing (unlike with the unloader cam) are unaffected and non-essential to the functioning of the shaft stop.

Figure 21:
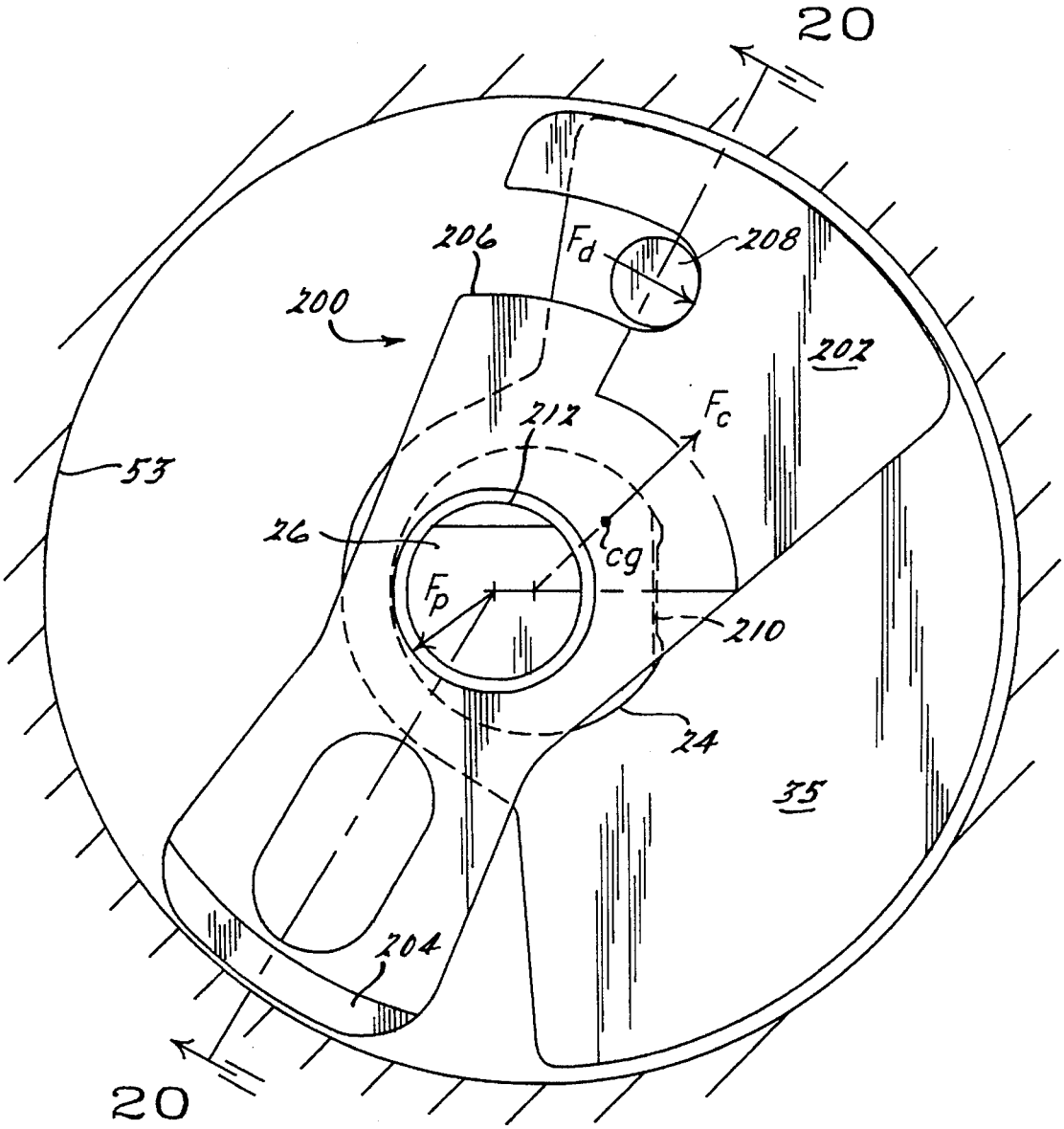

FIG. 21 shows the forces on the shaft stop in a steady state drive position. The center of gravity cg is positioned in such a manner that the centrifugal force induces reactions $F_p$ and $F_d$. $F_d$ opposes the moment created by $F_p$ and $F_c$, which results from the location of the center of gravity cg on the shaft stop. The magnitude of drive force $F_d$ is such that shaft stop 202 will not separate from drive pin 208 during normal operation, as is done with the unloader cam.

Figure 22:
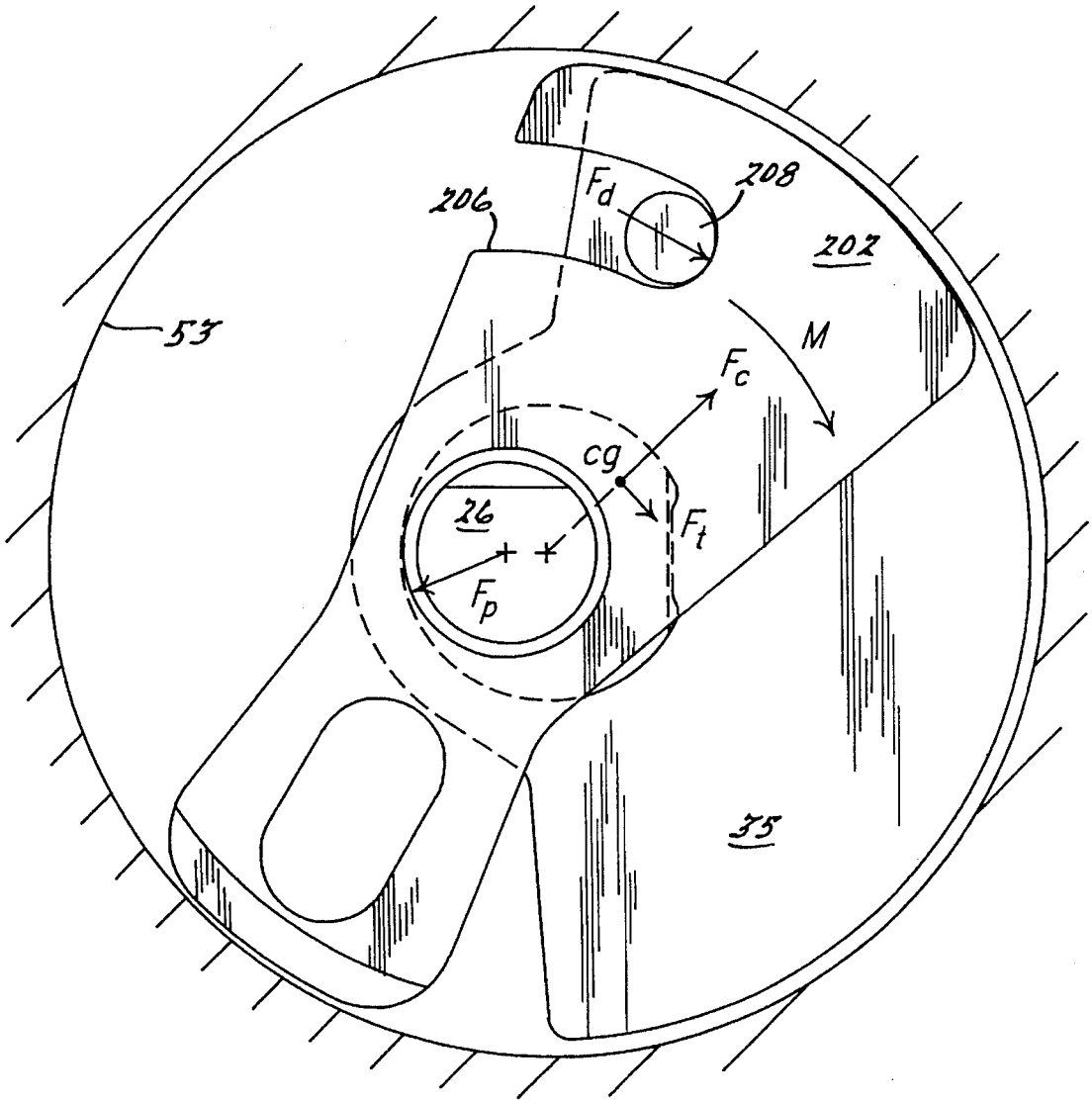

FIG. 22 defines the moments and forces acting on the shaft stop the instant the compressor is shut down and begins to decelerate. Both a tangential force $F_T$, associated with the shaft stop mass, and a moment M, associated with its inertia, are introduced by the deceleration. These vectors both act to reduce the magnitude of $F_d$. As the centrifugal force (which essentially created $F_d$) diminishes by a continued drop in angular speed, $F_d$ eventually becomes zero. At this instant the shaft stop begins to rotate ahead and away from drive pin 208.

Figure 23:
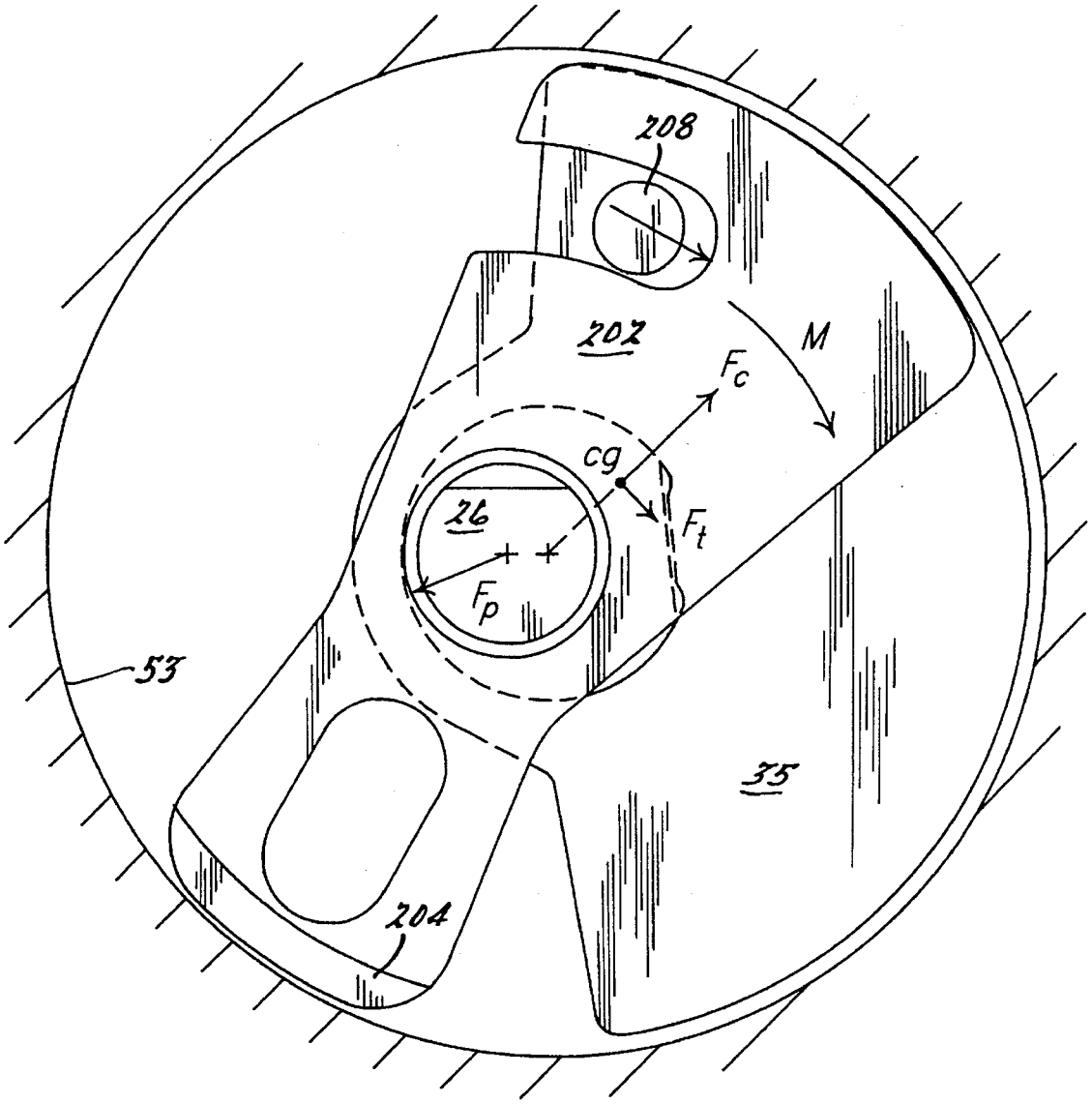
Figure 24:
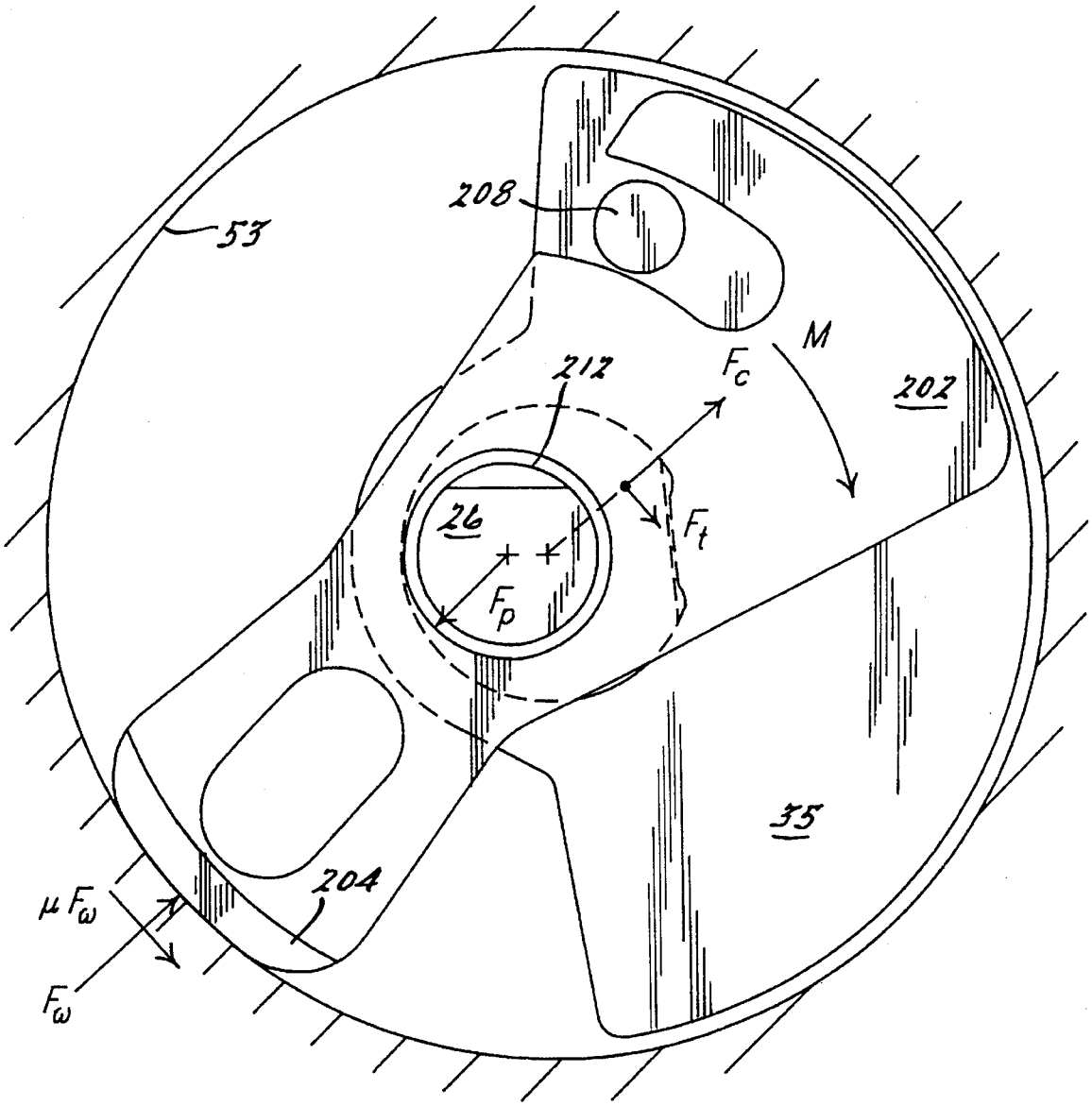

FIG. 23 depicts the shaft stop rotated slightly ahead of the shaft (both are still slowing down but at different rates). The clearance between the shaft stop pad 204 and wall surface 53 decreases until as shown in FIG. 24 it is zero. Engagement with surface 53 prevents any further change in the relative positions of the shaft stop and the crankshaft, so that they will now move at the same speed (for as much as 3 to 7 revolutions). Also, this instant a wall force $F_w$ appears. Because shaft 24 and shaft stop 202 are still both decelerating (at the same rate now), but still going forward, a wall friction force $\mu F_w$ appears, which opposes the clockwise motion of the shaft stop ($\mu$ is the coefficient of friction between the touching surfaces).

Figure 25:
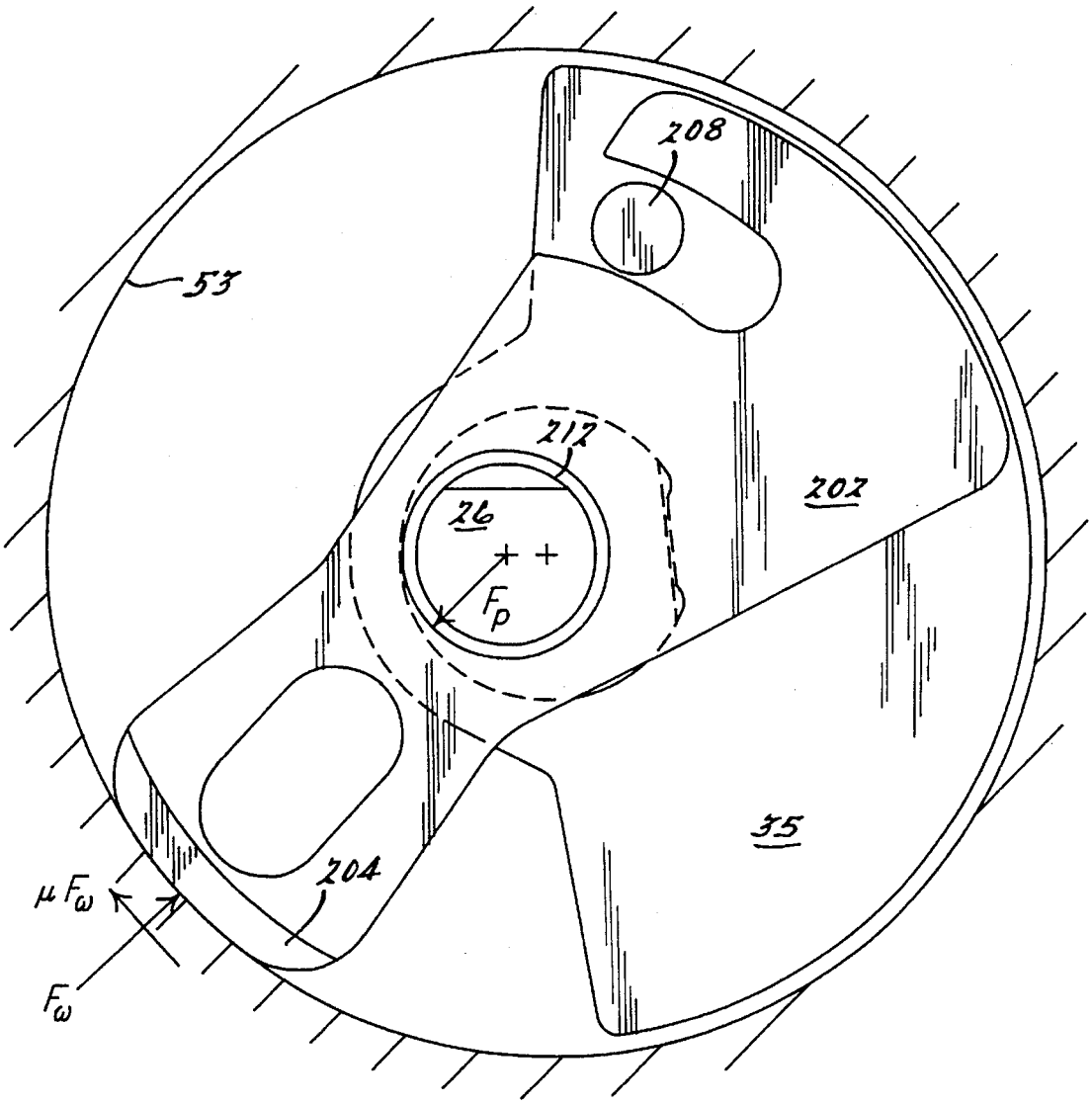

Eventually the compressor comes to a complete stop. The tangential gas force which has slowed and stopped the compressor in the forward direction now tries to induce motion in the reverse direction. Consequently, the wall friction force also changes direction and the shaft stop wedges itself between the wall surface 53 via pad 204 and crank pin shoulder 212 on the end of shaft 24 (FIG. 25). Having stopped the reversing motion, these forces are in equilibrium on the shaft stop, and it remains wedged in place. FIG. 26 shows the forces on the shaft at the wedging position of FIG. 25. The forces shown on the shaft, i.e., the reaction force $F_p$ on the crank pin and tangential gas force $F_{tg}$, are only those which can produce rotational motion and they too are in equilibrium. Consequently, there is no shaft angular motion. The compressor is restricted from reverse rotation.

Figure 27:
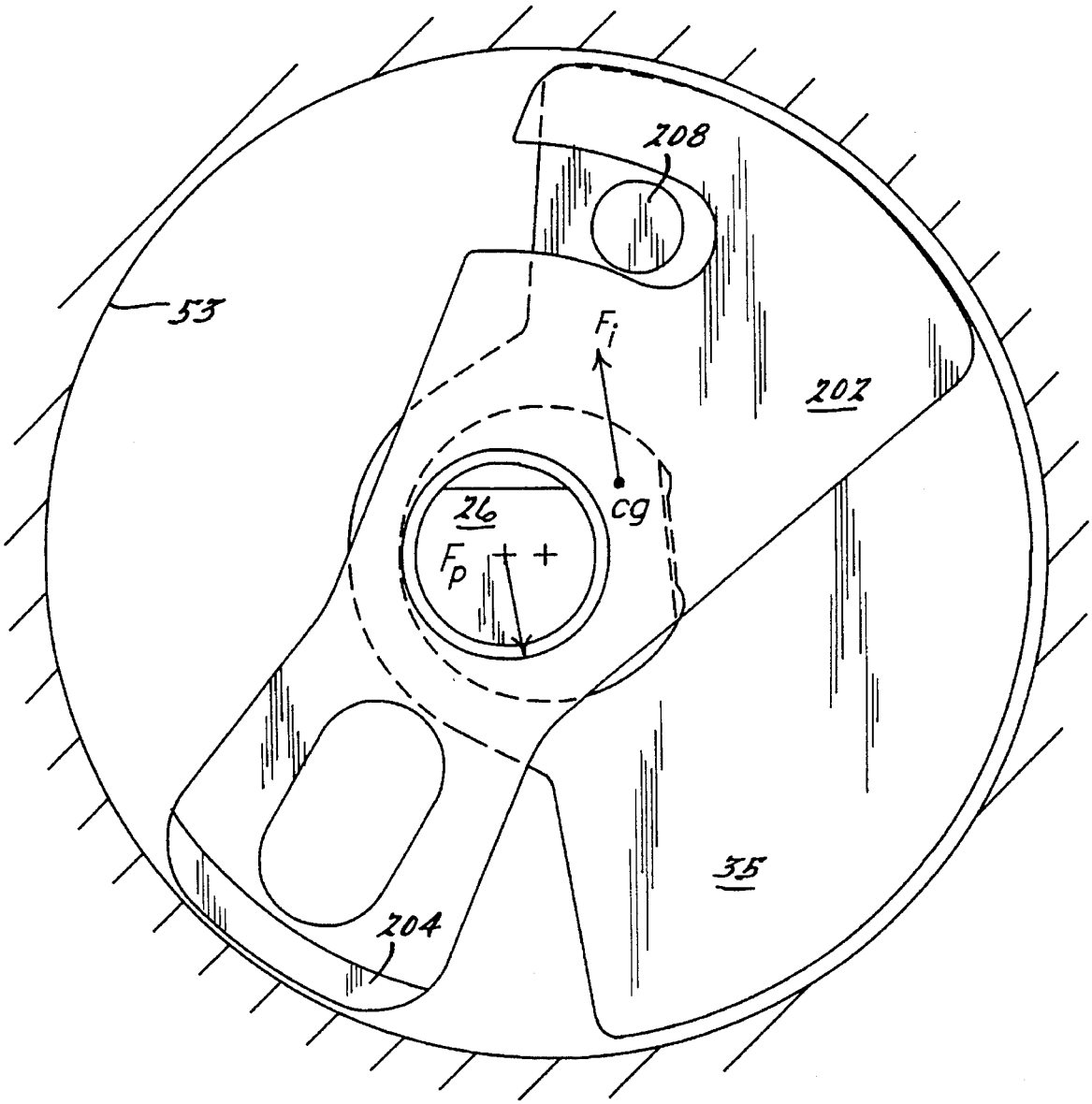
Figure 28:
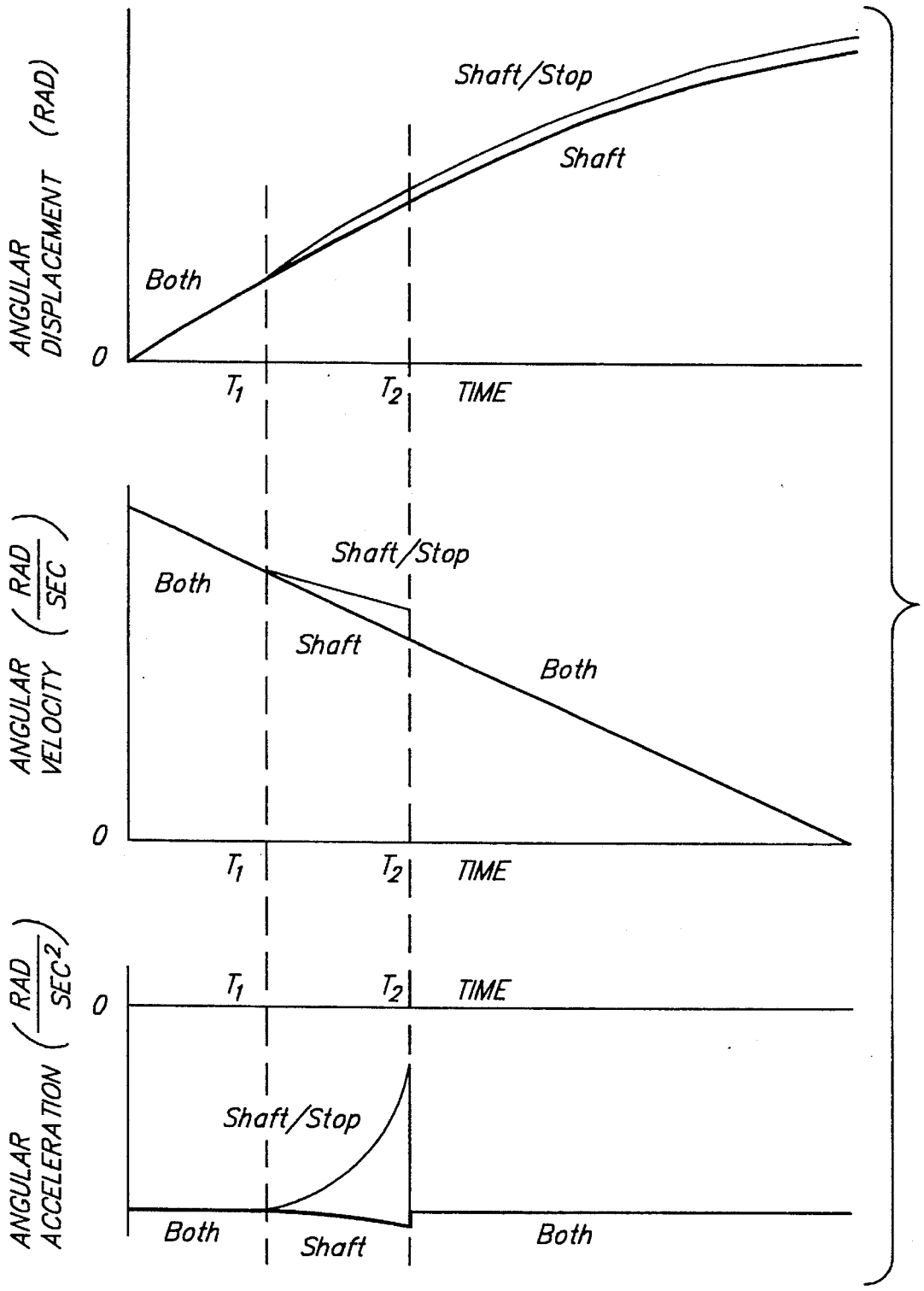

The shaft stop also acts to lock-up the compressor during powered reversal should the power source be a three-phase motor which is miswired. Essentially, when power is applied, the shaft starts rotating counterclockwise. This produces force $F_p$ on the shaft stop, which is reacted by an inertial force $F_i$ at the center of gravity cg as shown in FIG. 27. The resulting moment tends to rotate shaft stop 202 counterclockwise also, but at a much slower rate than that of shaft 24. Quickly, the shaft and shaft stop are in the positions shown in FIGS. 25 and 26. The only difference is the counterclockwise motor torque instead of the tangential gas force induced the lock-up. The stalled motor quickly overheats and trips protector 36 to shut off the motor so that the problem can be remedied.

Figure 28:
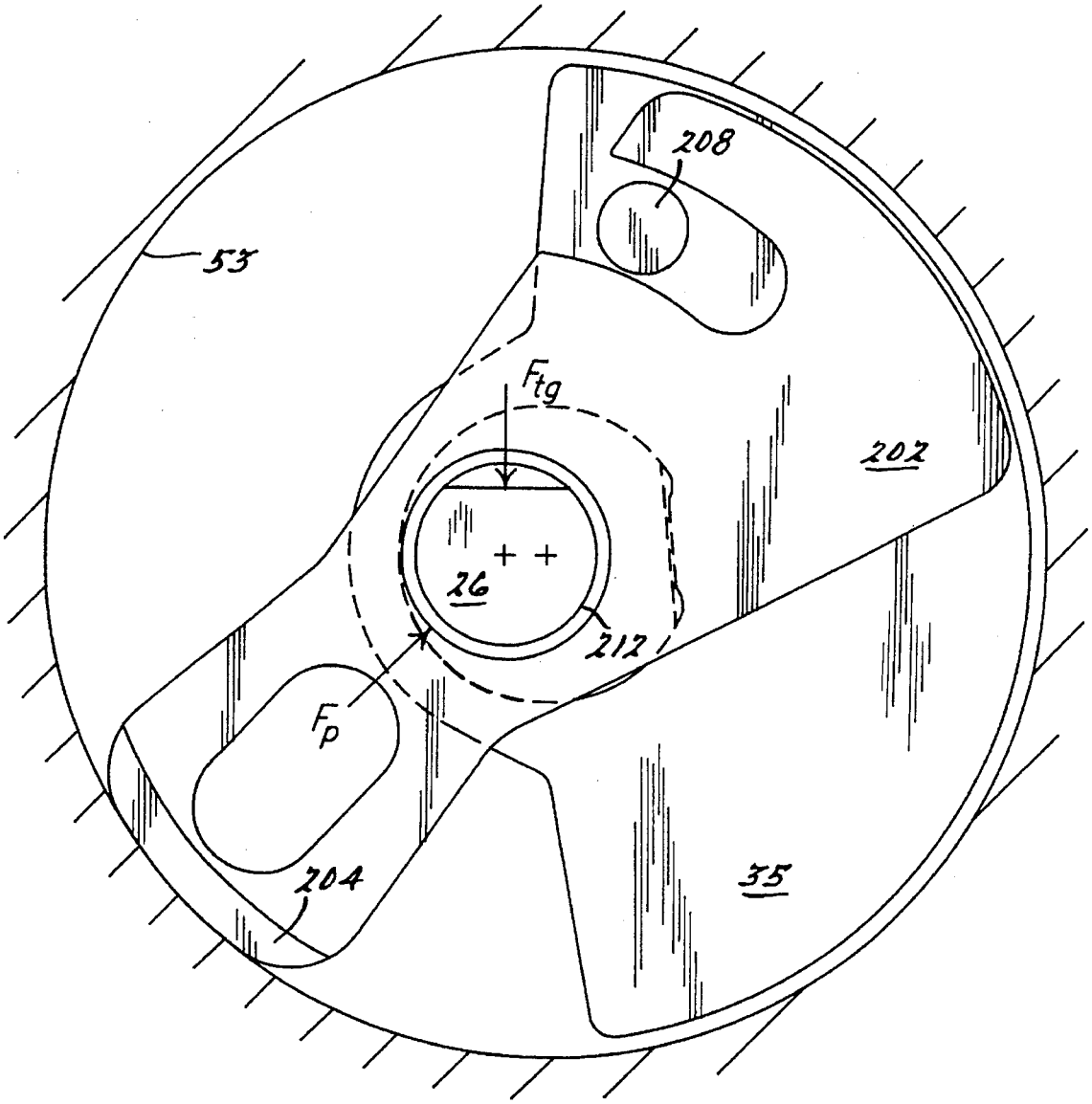
FIG. 28 is a set of graphs showing geometrically how the shaft stop operates.

FIG. 28 illustrates the angular position, angular velocity and angular acceleration of the shaft stop as a function of time. The graphs are self-explanatory bearing in mind that T=0 is the instant of shut-off, $T_1$ is the instant of separation of pin 208 from notch 206, and $T_2$ is the instant of contact of pad 204 with wall surface 53.

Single phase motors have a low starting torque and some scroll-motor configurations may not start because the orbiting scroll moves radially outward and begins pumping before the motor speed has increased enough to achieve a sustaining torque level. This is particularly true when the present invention is utilized. Without the present stopping devices, the compressor operates for a long enough period in reverse that sufficient vacuum is generated to pull floating seal 70 down, and bypass discharge to suction. With the present invention, however, the compressor stops so fast that the floating seal is not pulled down and it starts up pumping.

Figure 3:
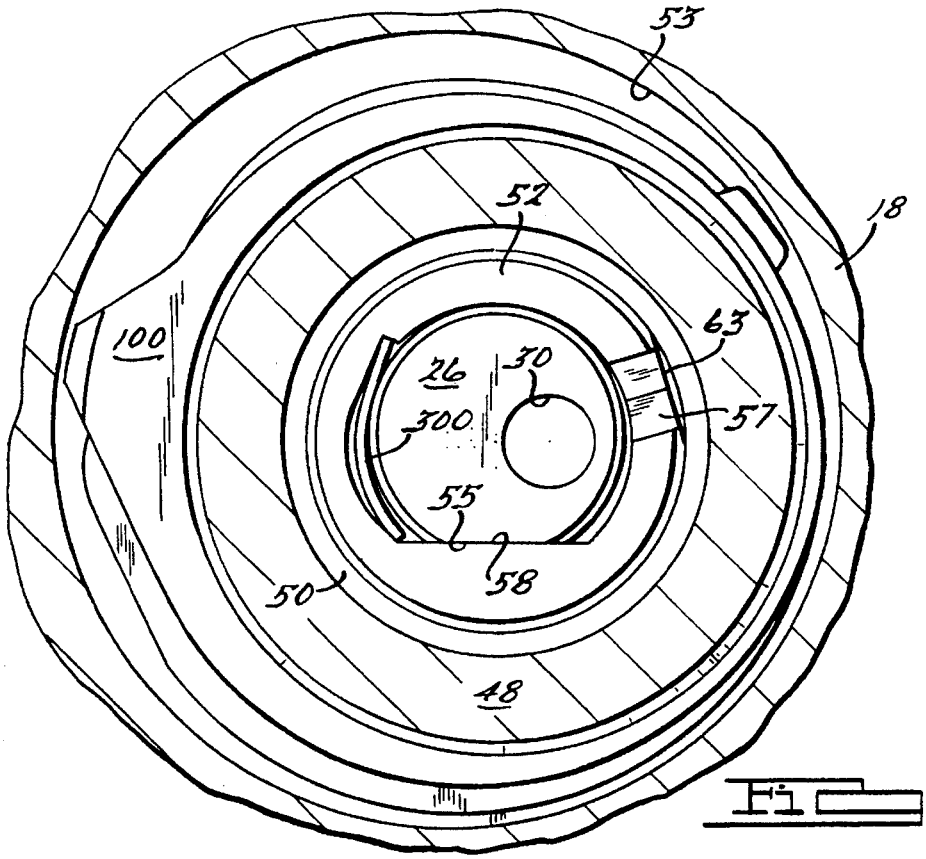
FIG. 3 is a sectional view taken along line 3—3 of FIG. 1.
Figure 4:
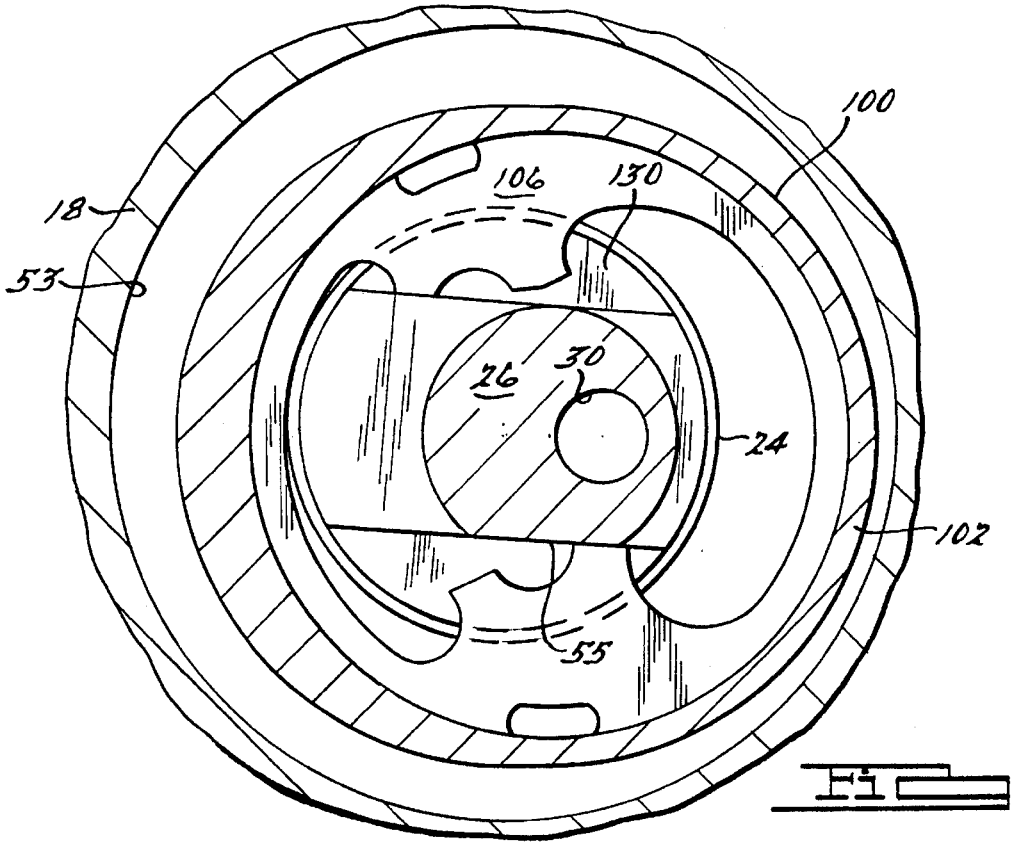
FIG. 4 is a sectional view taken along line 4—4 in FIG. 1.

Two solutions are available to preclude very early pumping, but they are both optional and may not be necessary in any particular application. The first approach is to make sure the wraps are radially separated and then delay the orbiting scroll from moving fully radially outward until sufficient priming torque is disclosed. This may be accomplished by installing a simple leaf spring 300 between shaft drive pin 26 and drive bushing 52, such as shown in FIG. 3. The spring should be sufficiently stiff to unload the scroll wraps when the compressor is not operating, but sufficiently weak that its force is easily overcome by the centrifugal force generated during operation, which is necessary for wrap sealing. The second approach is to put a time delay in pumping by having a timed high side leak. In the present scroll machine this is easily accomplished by spring loading the floating seal to cause it to open fully at shutdown. As shown in FIGS. 31 and 32, there is shown a spring 400 assembled in a compressor similar to that of FIG. 19 for biasing floating seal 70 downwardly away from set 67. Spring 400 is an annular leaf spring which is bowed so that its edge engages seat 67 and its convex bowed portion resiliently pushes against the top of floating seal 70 at diametrically spaced points. Spring 400 is designed so that closing the seal takes several revolutions during which the motor can build up torque.

Figure 33:
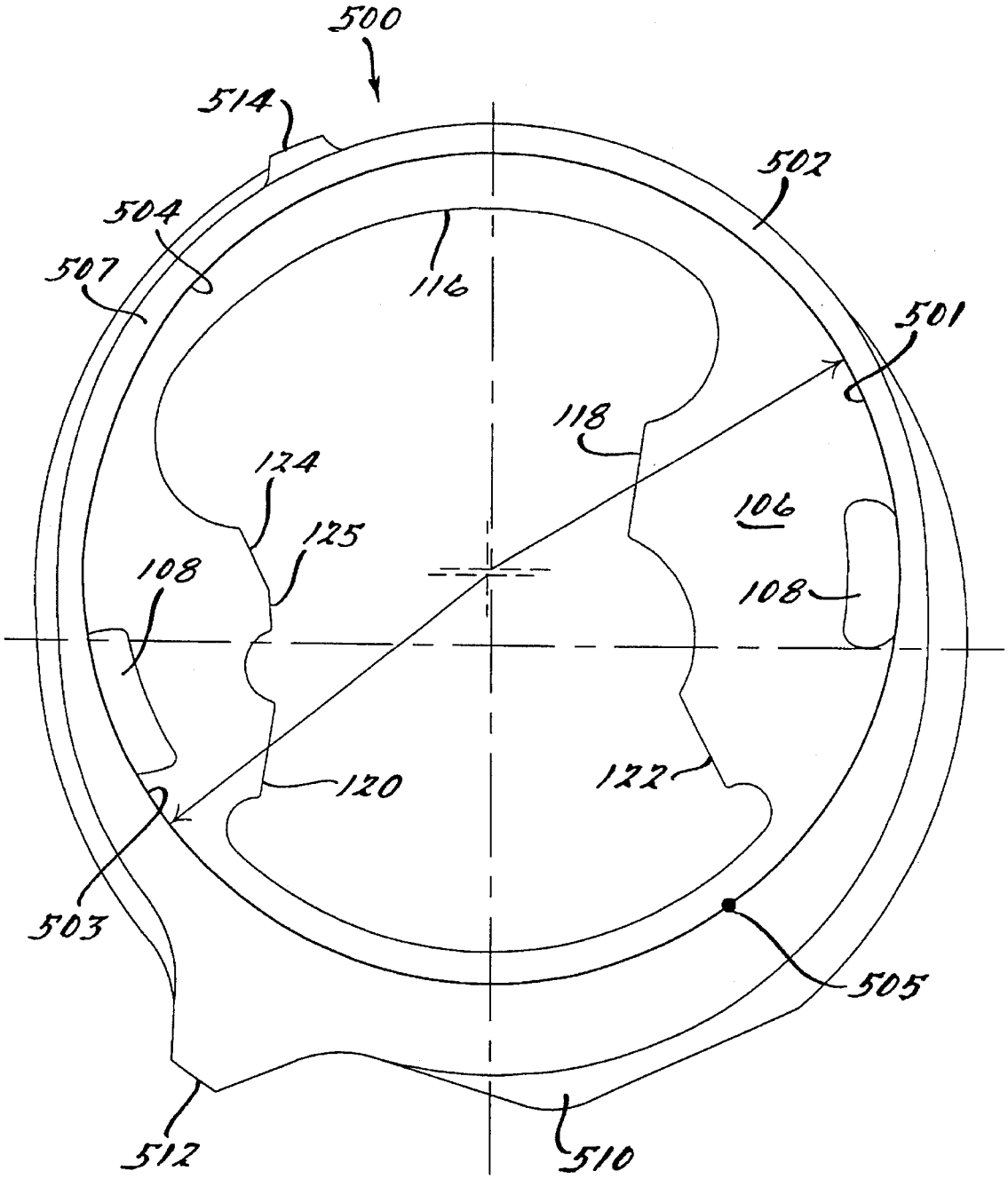
FIG. 33 is a top elevational view of an unloader cam embodying the principles of another embodiment of the present invention.
Figure 34:
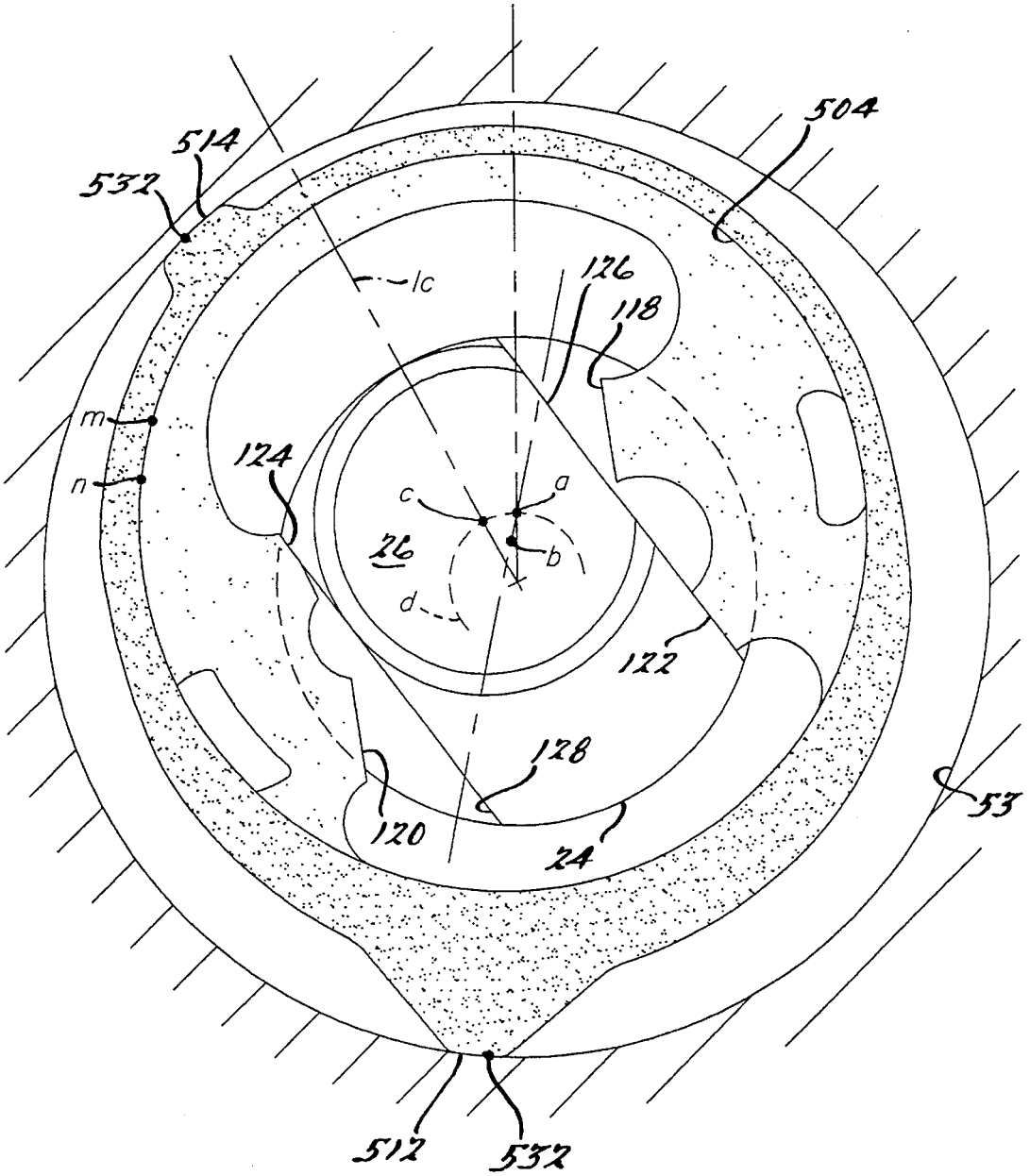
FIG. 34 is a diagrammatic illustration of how the unloader cam embodiment shown in FIG. 33 functions in various stages of operation.

FIGS. 33 and 34 show another embodiment of the cam of the present invention indicated at 500. Cam 500 is similar to cam 100 except that cam 500 has been designed to eliminate the rock-over feature described above for cam 100. This elimination of the rock-over feature has allowed for the repositioning of the pads for lower frictional requirements and reduced crankshaft rotation during unloading as will be described later herein.

Cam 500 is generally cup-shaped in overall configuration comprising a cylindrical sidewall 502 having an oblong inside surface 504 which is adapted to be journaled on the outside diameter of hub 48, and generally flat bottom wall 106 having a pair of drain holes 108 for draining lubricant and foreign matter. One portion of wall 502 is provided with a thickened portion 510 for the purposes of positioning the center of gravity at the desired position similar to thickened portion 110 of cam 100. Integrally formed on portion 510 is a first stop pad 512 adapted to frictionally engage brake surface 53 to prevent reverse rotation. Generally opposite first stop pad 512 is an integrally formed second stop pad 514 also adapted to engage brake surface 53. First and second stop pads 512 and 514 are positioned circumferentially on cam 500 and adapted such that during operation, stop pads 512 and 514 will contact brake surface 53 essentially simultaneously.

Oblong inside surface 504 is comprised of two separate radiused surfaces 501 and 503. The center of radiused surface 503 is disposed slightly below and to the left, as shown in FIG. 33, of the center of radiused surface 501. In the preferred embodiment, the center of radiused surface 503 is disposed 0.323 millimeters below and 0.255 millimeters to the left as shown in FIG. 33, of the center of radiused surface 501.

Radiused surface 501 is intended to be the same radius of curvature as the outside radius of scroll hub 48. To ensure radius surface 501 is never smaller than the outside radius of scroll hub 48, it is designed slightly larger by the manufacturing tolerance of both parts. Radiused surface 503 is slightly larger than radiused surface 501.

In the preferred embodiment, radiused surface 501 is generated having a radius of 21.50 mm, radiused surface 503 is generated having a radius of 21.65 mm.

The radiused surfaces 501 and 503 meet at flat section 507. Radiused surfaces 503 and 501 meet at cusp point 505.

Bottom wall 106 of cam 500 is provided with irregularly shaped opening 116 which defines the five separate relatively flat driven surfaces 118, 120, 122, 124 and 125, which are adapted to be driven by drive surfaces 126 and 128 formed at the top of crankshaft 24 at the base of crankpin 26. Cam 500 rests on the generally flat top 130 of crankshaft 24 with drive surfaces 126 and 128 engaging driven surfaces 118 and 120, respectively, in the forward direction of relative rotation, and with drive surfaces 126 and 128 engaging driven surfaces 122 and 124 or 125, respectively in the reverse direction of relative rotation. The result is essentially a lost motion positive drive connection between cam 500 and crankshaft 24.

Cam 500, similar to cam 100, functions at compressor shutdown by unloading orbiting scroll member 40 and holding it in check while allowing discharge gas to balance with suction gas. In doing so, the cam prevents discharge gas from driving the compressor in reverse, and thus eliminates the associated shut down noise.

At compressor shut down, an angular deceleration is introduced, similar to that described above for cam 100, which in turn produces a clockwise moment on the cam. This clockwise moment has two components, one associated with the cam mass, and the other associated with the cam rotational inertia. The introduction of these two new components to the force diagram of FIG. 9 is shown in dotted lines. The mass associated moment is termed $F_3$ and acts clockwise at cg, and the inertia associated moment is termed $M_3$ and also acts clockwise on the cam. Initially centrifugal force $F_1$ was used to create a counterclockwise moment; however, while the counterclockwise moment caused by $F_1$ decreases as the angular velocity decreases, the clockwise moment caused by $F_3$ and $M_3$ remains virtually constant. At some time during deceleration, the counterclockwise moment becomes less than the clockwise moment, and the cam rotates slightly clockwise away from the drive means (see the space between surfaces 118 and 126 and between surfaces 120 and 128 in FIG. 10). Up to this point, the operation of cam 500 has been identical to the operation of cam 100. The continued clockwise rotation of cam 500 will eventually cause first stop pad 512 and second stop pad 514 to essentially simultaneously contact braking surface 53 as shown at points 532 in FIG. 34. Simultaneously with the contact of pads 512 and 514 with braking surface 53 is the contact between the hub and the inside surface 504 of cam 500 at point m. Cam 500 is now in position to unload the orbiting scroll when the compressor finally stops coasting forward and just begins to rotate in the reverse. Due to the elimination of the rock-over feature, the amount of reverse rotation required for unloading is reduced and frictional engagement between pad 514 and brake surface 53 for "flipping the components" is eliminated. The frictional engagement between brake surface 53 and stop pads 512 and 514 is now only required during unloading of the compressor. The friction requirements for unloading are significantly lower than those required for "flipping" of the components of cam 100.

FIG. 34 represents the position of the components during the unloading of the compressor. The same tangential gas force which slowed and stopped the compressor's forward motion now causes a slight reverse motion starting at a. The tangential gas force in combination with the gas separating force causes radial movement of the orbiting scroll along flat 507 to unload the compressor. The orbiting scroll member's normal path of movement would be from point a to point c and beyond along path d defined by the orbiting radius. Because of the engagement of stop pads 512 and 514 with braking surface 53, the orbiting scroll is forced to move from point a to point b along a line parallel to the line connecting points m and n. This is due to the oblong configuration of inside surface 504. Points m and n are defined as the points the hub contacts inside surface 514 before and after movement of the orbiting scroll. The distance between point b and point a (FIG. 34) is the gap which is created between the orbiting scroll member wraps and those of the non-orbiting scroll member. This gap unloads the compressor by permitting gas at discharge pressure to flow back through the compressor to a zone of gas at suction pressure. The movement of the orbiting scroll within cam 500 is caused by the initial reverse rotation of the orbiting scroll due to the tangential discharge gas force and by the gas separating forces within the compressor.

When flank separation reaches a predetermined clearance dictated by the design of internal surface 504, the contact between stop pads 512 and 514 against wall surface 43 quickly dissipates the energy in the orbiting scroll, drive bushing and unloader cam itself, although the shaft is still turning in the reverse direction. The energy built up in these three components during the slight reversing of the compressor is small compared to the energy built up in the shaft. The energy in the shaft must also be dissipated, and this can be done by either impact or friction. By using impact, the back side of crank pin 26 (opposite drive surface 55) is allowed to hit the already stopped drive bushing. By using friction (the preferred way to dissipate shaft energy) a different approach is taken. Before impact of the crank pin with the already stopped drive bushing occurs, the crankshaft drive surfaces 126 and 128 engage the driven surfaces 122 and 124 on unloader cam 500 and turn it in reverse. However, cam 500 is pinned between scroll hub 48 and wall surface 53 at both stop pads 514 and 512. The friction at these pads is thus used to dissipate shaft energy as the shaft tries to rotate the cam in reverse. The cam need only turn 10°–15° along wall surface 53 before stopping the shaft.

Elimination of the rock-over or flipping requirement of the cam allows for the reduction of Θ P thus reducing the coefficient of wall friction required to cause the cam to function properly, as the motion from point a to point b is no longer determined by the flipping of the cam, since it is now determined by the design of the inside surface 504.

The operation and function of cam 500 during a powered reversal is similar to the operation and function of cam 100 described above with reference to FIGS. 14 through 18.

Figure 35:
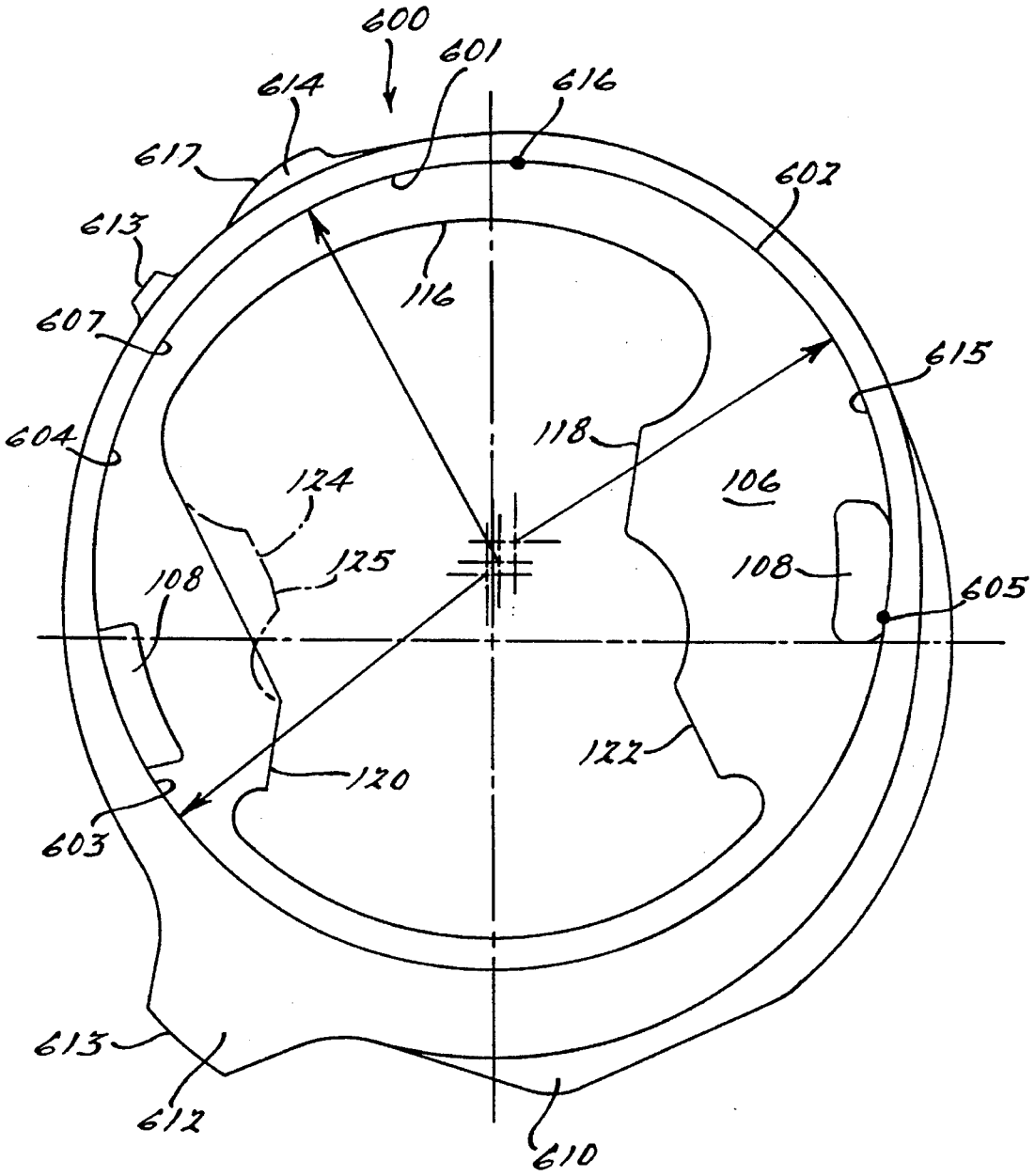
FIG. 35 is a top elevational view of an unloader cam embodying the principles of another embodiment of the present invention.
Figure 36:
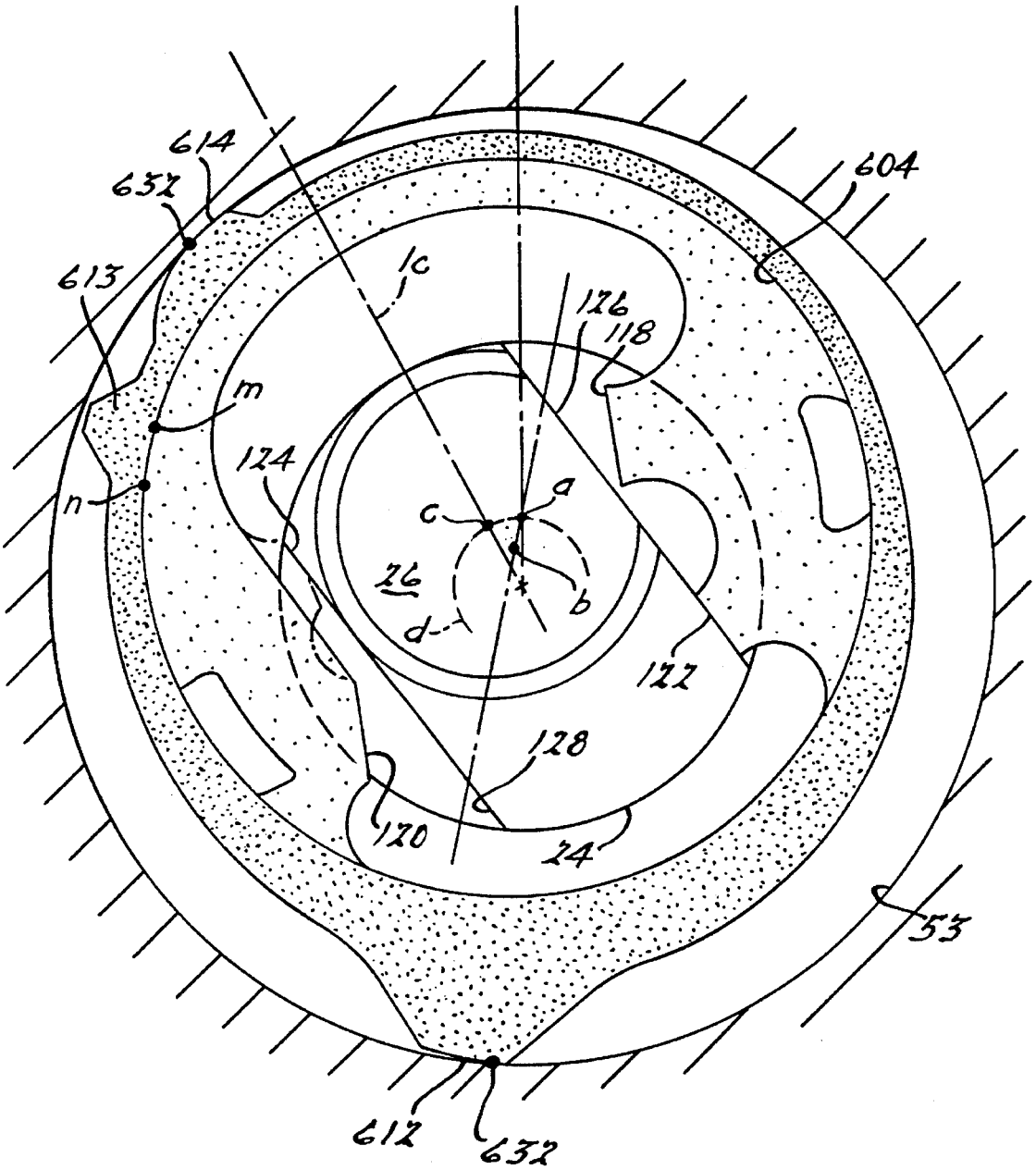
FIG. 36 is a diagrammatic illustration of how the unloader cam embodiment shown in FIG. 35 functions in various stages of operation.

FIGS. 35 and 36 show another embodiment of the cam of the present invention indicated generally at 600. Cam 600 is similar to cam 500 except that cam 600 has been provided with an additional stop pad to minimize the deflection of cam 600 at high load conditions.

Cam 600 is generally cup-shaped in overall configuration comprising a cylindrical sidewall 602 having an oblong inside surface 604 which is adapted to be journaled on the outside diameter of hub 48, and generally flat bottom wall 106 having a pair of drain holes 108 for draining lubricant and foreign matter. One portion of wall 602 is provided with a thickened portion 610 for the purposes of positioning the center of gravity at the desired position similar to thickened portion 510 of cam 500. Integrally formed on portion 610 is a first stop pad 612 having a radiused surface 613 for frictionally engaging brake surface 53 to prevent reverse rotation. Generally opposite first stop pad 612 is an integrally formed second stop pad 614 having a radiused surface 617 also for frictionally engaging brake surface 53. First and second stop pads 612 and 614 are positioned circumferentially on cam 600 and adapted such that during operation, stop pads 612 and 614 will contact brake surface 53 essentially simultaneously. The radiused surfaces 613 and 615 have a radius of curvature significantly smaller than the radius of brake surface 53 to eliminate edge contact during high load deflection of cam 600. This smaller radius of curvature provides a consistent and repeatable friction angle upon contact with brake surface 53.

A third stop pad 613 is formed integral to cylindrical sidewall 602 and is positioned circumferentially between stop pads 612 and 614 but closer to stop pad 614. Third stop pad 613 acts as a secondary stop pad to engage brake surface 53 subsequent to the engagement of stop pads 612 and 614. The engagement of stop pad 613 and brake surface 53 will occur only under high load conditions upon the deflection of cam sidewall 602. Similar to stop pad 612 and 614, stop pad 613 has a radius of curvature significantly smaller than the radius of brake surface 53. In the preferred embodiment, brake surface 53 has a radius of curvature of 29.2 mm, stop pad 612 has a radius of curvature of 23.228 mm, stop pad 613 has a radius of curvature of 23.50 mm and stop pad 614 has a radius of curvature of 21.490 mm.

Oblong inside surface 604 is comprised of three separate radiused surfaces 601, 603 and 615. The center of radiused surface 603 is disposed below and to the left, as shown in FIG. 35, of the center of radiused surface 601. In the preferred embodiment, the center of radiused surface 603 is disposed 0.498 mm below and 0.255 mm to the left, as shown in FIG. 35, of the center of radiused surface 601 and the center of radiused surface 615 is disposed above and to the right, as shown in FIG. 35, of the center of radiused surface 601. The center of radiused surface 615 is disposed 0.253 mm above and 0.377 mm to the right, as shown in FIG. 35, of the center of radiused surface 601. Radiused surface 601 is intended to be the same radius of curvature as the outside radius of scroll hub 48. In order to ensure that radiused surface 601 is never smaller than the outside radius of scroll hub 48, it is specified as being larger than scroll hub 48 by the manufacturing tolerances of each part. Radiused surface 603 is slightly larger than radiused surface 601. Radiused surface 615 is intended to be always smaller than the outside radius of scroll hub 48 in order that the contact point between cam 600 and scroll hub 48 defines a favorable direction for the contact force. In the preferred embodiment, radiused surface 601 has a radius of curvature of 21.50 mm, radiused surface 603 has a radius of curvature of 21.65 mm and radiused surface 615 has a radius of curvature of 21.25 mm. Radiused surfaces 601 and 603 meet at flat section 607, radiused surfaces 603 and 615 meet at cusp point 605 and radiused surfaces 615 and 601 meet at cusp point 616. While cusp point 605 and 616 are being defined as points, it is to be understood that a blend radius between the two respective radii can be located at either cusp point 605 or 616 if desired.

Bottom wall 106 of cam 600 is provided with irregularly shaped opening 116 which defines three separate flat driven surfaces 118, 120 and 122. Flat driven surfaces 124 and 125 shown on cam 500 have been removed for cam 600 when cam 600 is to be utilized in a single phase compressor as shown in solid lines in FIG. 35. Driven surfaces 122, 124 and 125 are provided to allow free rotation during a three-phase miswiring situation. As this is not an issue with a single phase compressor, cam 600 can be manufactured at a lower cost and a lower weight by eliminating stops 122, 124 and 125. Stop 122 is included in the single phase design of cam 600 in order to provide stability for the interface between cam 600 and crankshaft 24. When cam 600 is being incorporated into a three phase compressor, driven surfaces 124 and 125 are added, as shown in phantom in FIG. 35, to provide engagement with the shaft driving surface so that free rotation is allowed for possible miswiring situations.

Driven surfaces 118, 120 and 122, as well as surfaces 124 and 125 when present, are adapted to be driven by drive surfaces 126 and 128 formed at the top of crankshaft 24 at the base of crankpin 26. Cam 600 rests on the generally flat top 130 of crankshaft 24 with drive surfaces 126 and 128 engaging driven surfaces 118 and 120, respectively, in the forward direction of relative rotation, and with drive surfaces 126 and 128 engaging driven surfaces 122, and 124 or 125 when present, respectively in the reverse direction of rotation. The result is essentially a lost motion positive drive connection between cam 600 and crankshaft 24.

Cam 600, similar to cam 100, functions at compressor shutdown by unloading orbiting scroll member 40 and holding it in check while allowing discharge gas to balance with suction gas. In doing so, the cam prevents discharge gas from driving the compressor in reverse, and thus eliminates the associated shut down noise.

At compressor shut down, an angular deceleration is introduced, similar to that described above for cam 100, which in turn produces a clockwise moment on cam 600. This clockwise moment has two components, one associated with the cam mass, and the other associated with the cam rotational inertia. The introduction of these two new components to the force diagram of FIG. 9 is shown in dotted lines. The mass associated moment is termed $F_3$ and acts clockwise at cg, and the inertia associated moment is termed $M_3$ and also acts clockwise on the cam. Initially centrifugal force $F_1$ was used to create a counterclockwise moment; however, while the counterclockwise moment caused by $F_1$ decreases as the angular velocity decreases, the clockwise moment caused by $F_3$ and $M_3$ remains virtually constant. At some time during deceleration, the counterclockwise moment becomes less than the clockwise moment, and the cam rotates slightly clockwise away from the drive means (see the space between surfaces 118 and 126 and between surfaces 120 and 128 in FIG. 10). Up to this point, the operation of cam 600 has been identical to the operation of cam 100. The continued clockwise rotation of cam 600 will eventually cause first stop pad 612 and second stop pad 614 to essentially simultaneously contact braking surface 53 as shown at points 632 in FIG. 36. Simultaneously with the contact of pads 612 and 614 with braking surface 53 is the contact between the hub and the inside surface 604 of cam 600 at point m. Cam 600 is now in position to unload the orbiting scroll when the compressor finally stops coasting forward and just begins to rotate in the reverse. Due to the elimination of the rock-over feature, the amount of reverse rotation required for unloading is reduced and frictional engagement between pad 614 and brake surface 53 for "flipping the components" is eliminated. The frictional engagement between brake surface 53 and stop pads 612 and 614 is now only required during unloading of the compressor. The friction requirements for unloading are significantly lower than those required for "flipping" of the components of cam 100.

FIG. 36 represents the position of the components during the unloading of the compressor. The same tangential gas force which slowed and stopped the compressor's forward motion now causes a slight reverse motion starting at a. The tangential gas force in combination with the gas separating force causes radial movement of the orbiting scroll along flat 607 to unload the compressor. The orbiting scroll member's normal path of movement would be from point a to point c and beyond along path d defined by the orbiting radius. Because of the engagement of stop pads 612 and 614 with braking surface 53, the orbiting scroll is forced to move from point a to point b along a line parallel to the line connecting points rn and n. This is due to the oblong configuration of inside surface 604. Points m and n are defined as the points the hub contacts inside surface 604 before and after movement of the orbiting scroll. The distance between point b and point a (FIG. 36) is the gap which is created between the orbiting scroll member wraps and those of the non-orbiting scroll member. This gap unloads the compressor by permitting gas at discharge pressure to flow back through the compressor to a zone of gas at suction pressure. The movement of the orbiting scroll within cam 600 is caused by the initial reverse rotation of the orbiting scroll due to the tangential discharge gas force and by the gas separating forces within the compressor.

When flank separation reaches a predetermined clearance dictated by the design of internal surface 604, the contact between stop pads 612 and 614 against wall surface 53 quickly dissipates the energy in the orbiting scroll, drive bushing and unloader cam itself, although the shaft is still turning in the reverse direction. The energy built up in these three components during the slight reversing of the compressor is small compared to the energy built up in the shaft. The energy in the shaft must also be dissipated, and this can be done by either impact or friction. By using impact, the back side of crank pin 26 (opposite drive surface 55) is allowed to hit the already stopped drive bushing. By using friction (the preferred way to dissipate shaft energy) a different approach is taken. Before impact of the crank pin with the already stopped drive bushing occurs, crankshaft drive surfaces 126 and 128 engage the driven surfaces 122 and 124, when present, on unloader cam 600 and turn it in reverse. However, cam 600 is pinned between scroll hub 48 and wall surface 53 at both stop pads 612 and 614. The friction at these pads is thus used to dissipate shaft energy as the shaft tries to rotate the cam in reverse. The cam need only turn 10°–15° along wall surface 53 before stopping the shaft. Stop pad 613 is added to cam 600 in order to act as a secondary stop pad to engage brake surface 53 subsequent to the engagement of stop pads 612 and 614. The engagement of stop pad 613 with brake surface 53 will occur during a high load condition upon the deflection of cam sidewall 602.

Elimination of the rock-over or flipping requirement of the cam allows for the reduction of $\Theta$ P thus reducing the coefficient of wall friction required to cause the cam to function properly, as the motion from point a to point b is no longer determined by the flipping of the cam, since it is now determined by the design of the inside surface 604.

The operation and function of cam 600 during a powered reversal is similar to the operation and function of cam 100 described above.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A scroll compressor comprising:

(a) a first scroll member having a spiral wrap thereon;

(b) a second scroll member having a spiral wrap thereon;

(c) fixed mounting means for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

(d) a powered rotatable shaft normally rotating in a forward direction to cause said orbital movement in a forward direction;

(e) a braking surface defined on said mounting means; and (f) stop means adapted to engage said braking surface in response to sensed initial operation of said compressor in a reverse direction to stop said reverse operation.

2. A scroll compressor as claimed in claim 1 wherein said stop means is directly responsive to reverse movement of said second scroll member.

3. A scroll compressor as claimed in claim 1 wherein said stop means is directly responsive to reverse movement of said shaft.

4. A scroll compressor as claimed in claim 1 wherein said stop means is journaled on said second scroll member.

5. A scroll compressor as claimed in claim 1 wherein said stop means is journaled on said shaft.

6. A scroll compressor as claimed in claim 1 wherein said braking surface is generally circular and concentric with the rotational axis of said shaft.

7. A scroll compressor as claimed in claim 6 wherein said braking surface is circular cylindrical.

8. A scroll compressor as claimed in claim 6 wherein said stop means is an annular cam disposed between said second scroll member and said braking surface.

9. A scroll compressor as claimed in claim 6 wherein said shaft has an eccentric pin on one end for driving said second scroll member in an orbital path, said stop means being rotationally supported by said shaft and being disposed between said pin and said braking surface.

10. A scroll compressor as claimed in claim 9 further comprising spring means operable between said pin and said second scroll member to bias the latter in a direction to separate said wraps when said compressor is not operating, thereby reducing starting torque requirements.

11. A scroll compressor as claimed in claim 10 wherein said spring means is sufficiently weak that its effect will be overcome by the centrifugal force of said second scroll member after several revolutions of said shaft.

12. A scroll compressor as claimed in claim 1 further comprising means defining a normally closed leakage path between suction and discharge gas being compressed by said compressor, and spring means for opening said leakage path when said compressor is not operating, thereby reducing starting torque requirements.

13. A scroll compressor as claimed in claim 12 wherein said spring means is sufficiently weak that its effect will be overcome by the pressure created by several revolutions of said shaft.

14. A scroll compressor as claimed in claim 1 wherein said stop means is driven in the forward direction by and rotates with said shaft during normal operation of said compressor.

15. A scroll compressor as claimed in claim 1 wherein said stop means is inoperative to prevent powered reverse rotation of said shaft.

16. A scroll compressor as claimed in claim 1 wherein said stop means operates to stop powered reverse rotation of said shaft.

17. A scroll compressor as claimed in claim 1 wherein there is a lost motion driving connection between said shaft and said stop means.

18. A scroll compressor comprising:

(a) a first scroll member having a spiral wrap;

(b) a second scroll member having a spiral wrap and an annular drive hub;

(c) fixed mounting means for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

(d) a powered shaft rotatably mounted by said mounting means, said shaft being normally powered for rotation in a forward direction;

(e) an eccentric drive pin on said shaft disposed in said hub to cause said second scroll member to orbit in a forward direction upon rotation of said shaft in a forward direction;

(f) a cylindrical braking surface defined on said mounting means concentric with the rotational axis of said shaft and surrounding said hub; and (g) stop means comprising an annular cam journaled on the outside of said hub and having a stop surface adapted to engage said braking surface in response to sensed initial reverse orbital movement of said second scroll member to stop said reverse movement.

19. A scroll compressor as claimed in claim 18 wherein said cam normally rotates with and is powered by said shaft with clearance between said stop surface and said braking surface.

20. A scroll compressor as claimed in claim 19 wherein the drive connection between said cam and said shaft is a lost motion connection.

21. A scroll compressor as claimed in claim 20 wherein said stop means includes control means for preventing relative motion of said cam with respect to said shaft during normal forward rotation of said shaft.

22. A scroll compressor as claimed in claim 21 wherein said control means is the configuration of said cam so that its center of gravity is located at a position which creates a moment during normal forward rotation which is in a direction to resist said relative rotation.

23. A scroll compressor as claimed in claim 22 wherein said center of gravity is positioned so that said moment starts to decrease upon deenergization of said compressor whereby the angular position of said shaft begins to lag the corresponding angular position of said cam.

24. A scroll compressor as claimed in claim 23 wherein said cam has a pivot pad on its outside surface which touches said braking surface when the amount of said lag reaches a predetermined value.

25. A scroll compressor as claimed in claim 24 wherein said cam pivots about said pivot pad in response to discharge gas pressure biasing said second scroll member to orbit in the reverse direction until said stop surface also engages said braking surface to frictionally arrest reverse motion of said second scroll member.

26. A scroll compressor as claimed in claim 25 wherein said pivoting motion of said cam is transmitted to said second scroll member to cause the spiral wraps thereon to separate from the spiral wraps on said first scroll member, thereby unloading the compressor.

27. A scroll compressor as claimed in claim 25 wherein said cam has a reverse driving surface which is engaged by said shaft as said shaft begins to be driven in reverse by said discharge gas pressure, whereby the functional engagement of said pivot pad and said stop surface frictionally arrest the reverse rotation of said shaft.

28. A scroll compressor as claimed in claim 18 wherein powered reverse rotation of said shaft causes said cam to initially also rotate in the reverse direction, and wherein said cam is configured so that such reverse rotation causes a moment thereon which causes said cam to rotate slightly with respect to said shaft to create a gap between said stop surface and said braking surface to insure that said stop surface will not engage or drag upon said braking surface.

29. A scroll compressor as claimed in claim 28 wherein there is a relatively small clearance between said cam and hub which enhances said gap.

30. A scroll compressor as claimed in claim 19 wherein said shaft has a pair of circumferentially spaced outwardly facing drive surfaces and wherein said cam has at least four driven surfaces, two of said driven surfaces engaging said drive surfaces, respectively, when there is relative rotation between said cam and shaft in one direction, two other of said driven surfaces engaging said drive surfaces, respectively, when said relative rotation is in the opposite direction.

31. A scroll compressor as claimed in claim 30 wherein said drive surfaces are generally parallel to one another.

32. A scroll compressor as claimed in claim 30 wherein said cam is generally cup-shaped in configuration having a generally flat bottom wall, said driven surfaces being defined in an opening in said bottom wall.

33. A scroll compressor as claimed in claim 32 further comprising means defining a drain hole in said bottom wall adjacent the periphery thereof and spaced from said opening.

34. A scroll compressor as claimed in claim 18 further comprising a drive bushing rotatively journaled inside said hub and having a central opening partially defined by a flat driven surface, said drive pin being disposed in said opening and having a flat drive surface drivingly engaging said flat driven surface, said flat surfaces being slidable with respect to one another to permit unloading of said compressor.

35. A scroll compressor as claimed in claim 18 wherein each of said scroll members comprises an end plate with a spiral wrap disposed on one face thereof.

36. A scroll compressor as claimed in claim 35 wherein said hub is disposed on the opposite face of said end plate from said spiral wrap.

37. A scroll compressor as claimed in claim 18 wherein said first scroll member is a non-orbiting scroll member.

38. A scroll compressor as claimed in claim 18 further comprising spring means operable between said pin and said second scroll member to bias the latter in a direction to separate said wraps when said compressor is not operating, thereby reducing starting torque requirements.

39. A scroll compressor as claimed in claim 38 wherein said spring means is sufficiently weak that its effect will be overcome by the centrifugal force of said second scroll member after several revolutions of said shaft.

40. A scroll compressor as claimed in claim 18 further comprising means defining a normally closed leakage path between suction and discharge gas being compressed by said compressor, and spring means for opening said leakage path when said compressor is not operating, thereby reducing starting torque requirements.

41. A scroll compressor as claimed in claim 40 wherein said spring means is sufficiently weak that its effect will be overcome by the pressure created by several revolutions of said shaft.

42. A scroll compressor comprising:

(a) a first scroll member having a spiral wrap thereon;

(b) a second scroll member having a spiral wrap thereon;

(c) fixed mounting means for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

(d) a powered rotatable shaft normally rotating in a forward direction to cause said orbital movement in a forward direction;

(e) a cylindrical braking surface defined on said mounting means concentric with the rotational axis of said shaft; and (f) stop means journaled on said shaft for rotation about an axis parallel to and spaced from the axis of rotation of said shaft, said stop means having a stop surface adapted to engage said braking surface in response to sensed initial rotation of said shaft in a reverse direction to stop said reverse rotation.

43. A scroll compressor as claimed in claim 42 wherein said stop means normally rotates with and is powered by said shaft with clearance between said stop surface and said braking surface.

44. A scroll compressor as claimed in claim 43 wherein the drive connection between said stop means and said shaft is a lost motion connection.

45. A scroll compressor as claimed in claim 44 wherein said stop means includes control means for preventing relative motion of said stop means with respect to said shaft during normal forward rotation of said shaft.

46. A scroll compressor as claimed in claim 45 wherein said control means is the configuration of said stop means so that its center of gravity is located at a position which creates a moment during normal forward rotation which is in a direction to resist said relative rotation.

47. A scroll compressor as claimed in claim 46 wherein said center of gravity is positioned so that said moment starts to decrease upon deenergization of said compressor whereby the angular position of said shaft begins to lag the corresponding angular position of said stop means.

48. A scroll compressor as claimed in claim 47 wherein said stop surface touches said braking surface when the amount of said lag reaches a predetermined value.

49. A scroll compressor as claimed in claim 48 wherein said stop means and shaft coast together until the compressor comes to a complete stop.

50. A scroll compressor as claimed in claim 49 wherein any bias by gases being compressed to drive said shaft in the reverse direction will cause said stop means to wedge between said braking surface and said shaft to prevent such reverse rotation.

51. A scroll compressor as claimed in claim 42 wherein powering said shaft in the reverse direction will cause said stop means to wedge between said braking surface and said shaft to prevent such reverse rotation.

52. A scroll compressor as claimed in claim 42 wherein the axis of rotation of said stop means is spaced from the axis of rotation of said shaft by the radius of orbital movement of said second scroll member.

53. A scroll compressor as claimed in claim 42 wherein said stop means comprises an elongated hardened member extending diametrically across the cavity defined by said braking surface.

54. A scroll compressor as claimed in claim 42 further comprising a drive member fixed to said shaft for rotation therewith and having a driving abutment, said stop means having a driven abutment drivingly engageable by said driving abutment.

55. A scroll compressor as claimed in claim 54 wherein said drive member is a counterweight.

56. A scroll compressor as claimed in claim 55 wherein said stop means and said drive member are relatively flat and disposed parallel and adjacent one another.

57. A scroll compressor as claimed in claim 54 wherein one of said abutments is a pin and the other of said abutments is a slot adapted to receive said pin.

58. A scroll compressor as claimed in claim 57 wherein said slot is arcuate in the circumferential direction.

59. A scroll compressor as claimed in claim 57 wherein said pin is on said drive member.

60. A scroll compressor as claimed in claim 54 wherein the drive connection between said drive member and said stop means is a lost motion connection.

61. A scroll compressor as claimed in claim 42 wherein said shaft has an eccentric crank pin for causing said second scroll member to move in an orbital path, said stop means being journaled on said crank pin.

62. A scroll compressor as claimed in claim 42 wherein said shaft has an eccentric crank pin for causing said second scroll member to move in an orbital path, and further comprising spring means operable between said crank pin and said second scroll member to bias the latter in a direction to separate said wraps when said compressor is not operating, thereby reducing starting torque requirements.

63. A scroll compressor as claimed in claim 62 wherein said spring means is sufficiently weak that its effect will be overcome by the centrifugal force of said second scroll member after several revolutions of said shaft.

64. A scroll compressor as claimed in claim 42 further comprising means defining a normally closed leakage path between suction and discharge gas being compressed by said compressor, and spring means for opening said leakage path when said compressor is not operating, thereby reducing starting torque requirements.

65. A scroll compressor as claimed in claim 64 wherein said spring means is sufficiently weak that its effect will be overcome by the pressure created by several revolutions of said shaft.

66. A scroll compressor comprising:

(a) a first scroll member having a spiral wrap thereon;

(b) a second scroll member having a spiral wrap thereon and a hub;

(c) fixed mounting means for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

(d) a powered rotatable shaft normally rotating in a forward direction to cause said orbital movement in a forward direction;

(e) a braking surface defined on said mounting means; and (f) stop means comprising an annular cam having at least one stop surface adapted to engage said braking surface in response to sensed initial reverse orbital movement of said second scroll member to stop said reverse movement, said annular cam having an oblong inner surface for engagement with the outside surface of said hub.

67. A scroll compressor as claimed in claim 66 wherein said cam normally rotates with and is powered by said shaft with clearance between said stop surface and said braking surface.

68. A scroll compressor as claimed in claim 67 wherein the drive connection between said cam and said shaft is a lost motion connection.

69. A scroll compressor as claimed in claim 68 wherein said stop means includes control means for preventing relative motion of said cam with respect to said shaft during normal forward rotation of said shaft.

70. A scroll compressor as claimed in claim 69 wherein said control means is the configuration of said cam so that its center of gravity is located at a position which creates a moment during normal forward rotation which disengages said at least one stop surface from said braking surface.

71. A scroll compressor as claimed in claim 70 wherein said center of gravity is positioned so that said moment starts to decrease upon deenergization of said compressor whereby said at least one stop surface engages said braking surface.

72. A scroll compressor as claimed in claim 71 wherein movement of said hub along said oblong inner surface of said annular cam is transmitted to said second scroll member to cause the spiral wraps thereon to separate from the spiral wraps on said first scroll member, thereby unloading the compressor.

73. A scroll compressor as claimed in claim 71 wherein said cam has a reverse driving surface which is engaged by said shaft as said shaft begins to be driven in reverse by said discharge gas pressure, whereby the functional engagement of said stop surface frictionally arrest the reverse rotation of said shaft.

74. A scroll compressor as claimed in claim 66 wherein powered reverse rotation of said shaft causes said cam to initially also rotate in the reverse direction, and wherein said cam is configured so that such reverse rotation causes a moment thereon which causes said cam to rotate slightly with respect to said shaft to create a gap between said stop surface and said braking surface to insure that said stop surface will not engage or drag upon said braking surface.

75. A scroll compressor as claimed in claim 74 wherein there is a relatively small clearance between said cam and said hub which enhances said gap.

76. A scroll compressor as claimed in claim 67 wherein said shaft has a pair of circumferentially spaced outwardly facing drive surfaces and wherein said cam has at least four driven surfaces, two of said driven surfaces engaging said drive surfaces, respectively, when there is relative rotation between said cam and shaft in one direction, two other of said driven surfaces engaging said drive surfaces, respectively, when said relative rotation is in the opposite direction.

77. A scroll compressor as claimed in claim 76 wherein said drive surfaces are generally parallel to one another.

78. A scroll compressor as claimed in claim 76 wherein said cam is generally cup-shaped in configuration having a generally flat bottom wall, said driven surfaces being defined in an opening in said bottom wall.

79. A scroll compressor as claimed in claim 78 further comprising means defining a drain hole in said bottom wall adjacent the periphery thereof and spaced from said opening.

80. A scroll compressor as claimed in claim 66 further comprising a drive bushing rotatively journaled inside said hub and having a central opening partially defined by a flat driven surface, said drive pin being disposed in said opening and having a flat drive surface drivingly engaging said flat driven surface, said flat surfaces being slidable with respect to one another to permit unloading of said compressor.

81. A scroll compressor as claimed in claim 66 wherein each of said scroll members comprises an end plate with a spiral wrap disposed on one face thereof.

82. A scroll compressor as claimed in claim 81 wherein said hub is disposed on the opposite face of said end plate from said spiral wrap.

83. A scroll compressor as claimed in claim 66 wherein said first scroll member is a non-orbiting scroll member.

84. A scroll compressor as claimed in claim 66 further comprising spring means operable between said pin and said second scroll member to bias the latter in a direction to separate said wraps when said compressor is not operating, thereby reducing starting torque requirements.

85. A scroll compressor as claimed in claim 84 wherein said spring means is sufficiently weak that its effect will be overcome by the centrifugal force of said second scroll member after several revolutions of said shaft.

86. A scroll compressor as claimed in claim 66 further comprising means defining a normally closed leakage path between suction and discharge gas being lo compressed by said compressor, and spring means for opening said leakage path when said compressor is not operating, thereby reducing starting torque requirements.

87. A scroll compressor as claimed in claim 86 wherein said spring means is sufficiently weak that its effect will be overcome by the pressure created by several revolutions of said shaft.

88. A scroll compressor as claimed in claim 66 wherein said oblong inner surface includes at least one planar portion.

89. A scroll compressor as claimed in claim 66 wherein said oblong inner surface includes at least two curved portions.

90. A scroll compressor as claimed in claim 89 wherein said two curved portions are formed using different radiuses.

91. A scroll compressor as claimed in claim 66 wherein, said shaft has a pair of circumferentially spaced outwardly facing drive surfaces and wherein said cam has at least two driven surfaces, said driven surfaces engaging said drive surfaces when there is relative rotation between said cam and said shaft in one direction.

92. A scroll compressor as claimed in claim 91 wherein said drive surfaces are generally parallel to one another.

93. A scroll compressor as claimed in claim 91 wherein said cam is generally cup-shaped in configuration having a generally flat bottom wall, said driven surfaces being defined in an opening in said bottom wall.

94. A scroll compressor as claimed in claim 91 further comprising means defining a drain hole in said bottom wall adjacent the periphery thereof and spaced from said opening.

95. A scroll compressor as claimed in claim 66 wherein, said oblong inner surface includes at least three curved portions.

96. A scroll compressor as claimed in claim 95 wherein, said three curved portions are formed using different radii.

97. A scroll compressor comprising:

(a) a first scroll member having a spiral wrap thereon;

(b) a second scroll member having a spiral wrap thereon and a hub;

(c) fixed mounting means for mounting said scroll members so that said second scroll member orbits with regard to said first scroll member with the respective spiral wraps of each scroll member engaging one another in such a way that pockets of progressively changing volume are created between said scroll members in response to said orbital movement in a forward direction;

(d) a powered rotatable shaft normally rotating in a forward direction to cause said orbital movement in a forward direction;

(e) a braking surface defined on said mounting means; and (f) stop means comprising an annular cam having at least one stop surface adapted to engage said braking surface in response to sensed initial reverse orbital movement of said second scroll member to stop said reverse movement, said annular cam having an inner surface adapted to engage the outside of said hub.

98. A scroll compressor as claimed in claim 97 wherein said inner surface includes at least one planar portion.

99. A scroll compressor as claimed in claim 97 wherein said inner surface includes at least two curved portions.

100. A scroll compressor as claimed in claim 99 wherein said two curved portions are formed using different radii.

101. A scroll compressor as claimed in claim 97 wherein, said oblong inner surface includes at least three curved portions.

102. A scroll compressor as claimed in claim 101 wherein, said three curved portions are formed using different radii.

* * * * *

UNITED STATES PATENT AND TRADEMARK OFFICE

CERTIFICATE OF CORRECTION

PATENT NO. : 5,545,019

DATED : August 13, 1996

INVENTOR(S) : Norman G. Beck; Gary J. Anderson; Richard S. Tucker

It is certified that error appears in the above-indentified patent and that said Letters Patent is hereby corrected as shown below:

On the title page, under "Related U.S. Application Data", before "Continuation-in-part" insert -- Continuation-in-part of Ser. No. PCT/US93/06307, Jul. 2, 1993 which is a --.

Column 1, line 29, "pod" should be -- port --.

Column 5, line 18, "applicant's" should be -- applicants' --.

Column 5, line 46, delete "a".

Column 7, line 32, delete "63".

Column 7, line 44, "e" should be -- ⊖ --.

Column 8, line 36, "drag" should be -- dragging --.

Column 16, line 66, "a" should be -- said --.

Column 18, line 9, "a" should be -- said --.

Column 18, line 10, "a" should be -- said --

Column 19, line 6, "19" should be -- 18 --.

Column 20, line 2, "a" should be -- said --.

Column 21, line 47, "a" should be -- said --.

UNITED STATES PATENT AND TRADEMARK OFFICE

CERTIFICATE OF CORRECTION

PATENT NO. : 5,545,019

DATED : August 13, 1996

INVENTOR(S) : Norman G. Beck; Gary J. Anderson; Richard S. Tucker

It is certified that error appears in the above-indentified patent and that said Letters Patent is hereby corrected as shown below:

Column 22, line 33, "67" should be -- 66 --.

Column 23, line 9, after "being" delete "lo".

Column 24, line 19, "a" should be -- said --.

Signed and Sealed this

Eleventh Day of February, 1997

*Attest:*

*Attesting Officer*

BRUCE LEHMAN

*Commissioner of Patents and Trademarks*